US011413888B2

(12) United States Patent
Takabayashi

(10) Patent No.: US 11,413,888 B2
(45) Date of Patent: Aug. 16, 2022

(54) MEDIUM SUPPORT DEVICE AND RECORDING APPARATUS

(71) Applicant: SEIKO EPSON CORPORATION, Tokyo (JP)

(72) Inventor: Kazunori Takabayashi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/203,276

(22) Filed: Mar. 16, 2021

(65) Prior Publication Data

US 2021/0291560 A1 Sep. 23, 2021

(30) Foreign Application Priority Data

Mar. 19, 2020 (JP) ..... JP2020-048810

(51) Int. Cl.

| | |
|---|---|
| ***B41J 11/00*** | (2006.01) |
| ***B65H 1/04*** | (2006.01) |
| ***B65H 1/02*** | (2006.01) |
| ***B65H 1/06*** | (2006.01) |
| *B41J 13/24* | (2006.01) |

(52) U.S. Cl.

CPC ..... *B41J 11/007* (2013.01); *B41J 11/0045* (2013.01); *B65H 1/02* (2013.01); *B65H 1/04* (2013.01); *B65H 1/06* (2013.01); *B41J 13/24* (2013.01); *B65H 2402/44* (2013.01); *B65H 2405/32* (2013.01); *B65H 2405/321* (2013.01)

(58) Field of Classification Search

CPC ..... B41J 11/007; B41J 11/0045; B41J 13/24; B65H 1/02; B65H 1/04; B65H 1/06; B65H 2402/44; B65H 2405/32; B65H 2405/321

See application file for complete search history.

(56) References Cited

U.S. PATENT DOCUMENTS

| | | | | |
|---|---|---|---|---|
| 2013/0221598 | A1* | 8/2013 | Washino | B65H 31/20 271/3.14 |
| 2014/0241775 | A1* | 8/2014 | Kawashima | B65H 1/04 399/367 |
| 2015/0097329 | A1* | 4/2015 | Ukai | B65H 1/04 271/9.12 |
| 2018/0034986 | A1 | 2/2018 | Ishida et al. | |

FOREIGN PATENT DOCUMENTS

| | | |
|---|---|---|
| JP | 2007-217162 | 8/2007 |
| JP | 2010-030755 | 2/2010 |
| JP | 2015-110471 | 6/2015 |
| JP | 2018-016050 | 2/2018 |

* cited by examiner

*Primary Examiner* — Henok D Legesse
(74) *Attorney, Agent, or Firm* — Workman Nydegger

(57) ABSTRACT

A medium support device includes: a first support section that transits between a first position and a second position relative to a main body; a second support section that transits between a retracted position and a protruding position relative to the first support section; and a locking mechanism configured to set a lock the second support section. When the first support section is in the first position and the second support section is retracted into the first support section, the retracted state is formed. When the first support section is in the second position and the second support section protrudes from the first support, the extended state is formed. The locking mechanism locks the second support section retracted into the first support section when the first support section is in the first position and releases the lock when the first support section is in the second position.

15 Claims, 21 Drawing Sheets

MEDIUM SUPPORT DEVICE AND RECORDING APPARATUS

The present application is based on, and claims priority from JP Application Serial Number 2020-048810, filed Mar. 19, 2020, the disclosure of which is hereby incorporated by reference herein in its entirety.

BACKGROUND

1. Technical Field

The present disclosure relates to a medium support device that supports a medium and to a recording apparatus including the medium support device.

2. Related Art

Devices that support media, called medium support devices, are provided in some recording apparatuses such as printers and image reading apparatuses such as document scanners. Examples of such medium support devices include: paper-feeding trays that support paper sheets to be processed; and paper-ejecting trays that receive processed paper sheets.

JP-A-2018-016050 discloses a paper-feeding tray as an example of medium support devices as described above. This paper-feeding tray is usually stored inside a recording apparatus in a vertical position. However, by pulled up and tilted backward by a user, the paper-feeding tray can be used as a paper-sheet placement surface. In addition, the paper-feeding tray includes a plurality of extendable members so that a user can adjust the length of the paper-sheet placement surface.

When placing a small-sized medium on the paper-sheet placement surface of the above medium support device, a user may sometimes pull up the medium support device only halfway. More specifically, he/she may fully extend a member on the top but extend another member on the bottom halfway. In this case, the medium support device may fail to support the medium in an appropriate attitude because the member on the top is warped more easily than the member on the bottom is. This disadvantage is more likely to arise when a larger number of media are placed on the paper-sheet placement surface. Therefore, it is preferable to fix the sequence in which the individual members of the medium support device are expended.

To fix the above sequence, it is necessary to appropriately set retentive forces applied to the respective members of the medium support device. With reference to FIGS. 21A and 21B, a description will be given below of a method of setting the individual retentive forces. In FIGS. 21A and 21B, a medium support device 100 includes a first member 101, a second member 102, and a main body 103. When the medium support device 100 is extended, the first member 101 is positioned on the bottom, whereas the second member 102 is positioned on the top. When the medium support device 100 is retracted, the second member 102 is positioned inside the first member 101, whereas the first member 101 is positioned inside the main body 103.

When a user grabs and pulls up the second member 102 in such a way that the first member 101 is extended from the main body 103 with the second member 102 therein, as illustrated in FIG. 21A, a retentive force F2 by which the second member 102 is kept inside the first member 101 is set to be greater than the gravity generated by the mass of the first member 101. In this case, the retentive force F2 is also set to be greater than a retentive force by which the first member 101 is kept inside the main body 2. If the first member 101 is enlarged in order to support a large-sized medium or if the medium support device 100 includes many more members, the retentive force F2 is set to a further greater value. As a result, the user needs to pull up the second member 102 at a considerably strong operating force M, which exceeds the retentive force F2, in order to extend the second member 102 from the first member 101 as illustrated in FIG. 21B. Unfortunately, this operation cannot be convenient for the user.

SUMMARY

The present disclosure is a medium support device that is configured to switch between an extended state where a support surface of the medium support device which supports a medium is extended from a main body and a retracted state where the support surface of the medium support device is retracted into the main body. The main body has a processor that processes the medium. The medium support device includes: a first support section configured to transit between a first position and a second position relative to the main body; a second support section configured to transit between a position in which the second support section is retracted into the first support section and a position in which the second support section protrudes from the first support section, the second support section being supported by the first support section; and a locking mechanism configured to set a lock to the second support section. When the first support section is in the first position and the second support section is retracted into the first support section, the retracted state is formed. When the first support section is in the second position and the second support section protrudes from the first support section, the extended state is formed. The locking mechanism sets the lock to the second support section retracted into the first support section when the first support section is in the first position and, in turn, releases the lock when the first support section is in to the second position.

DESCRIPTION OF EXEMPLARY EMBODIMENTS

Figure 1:
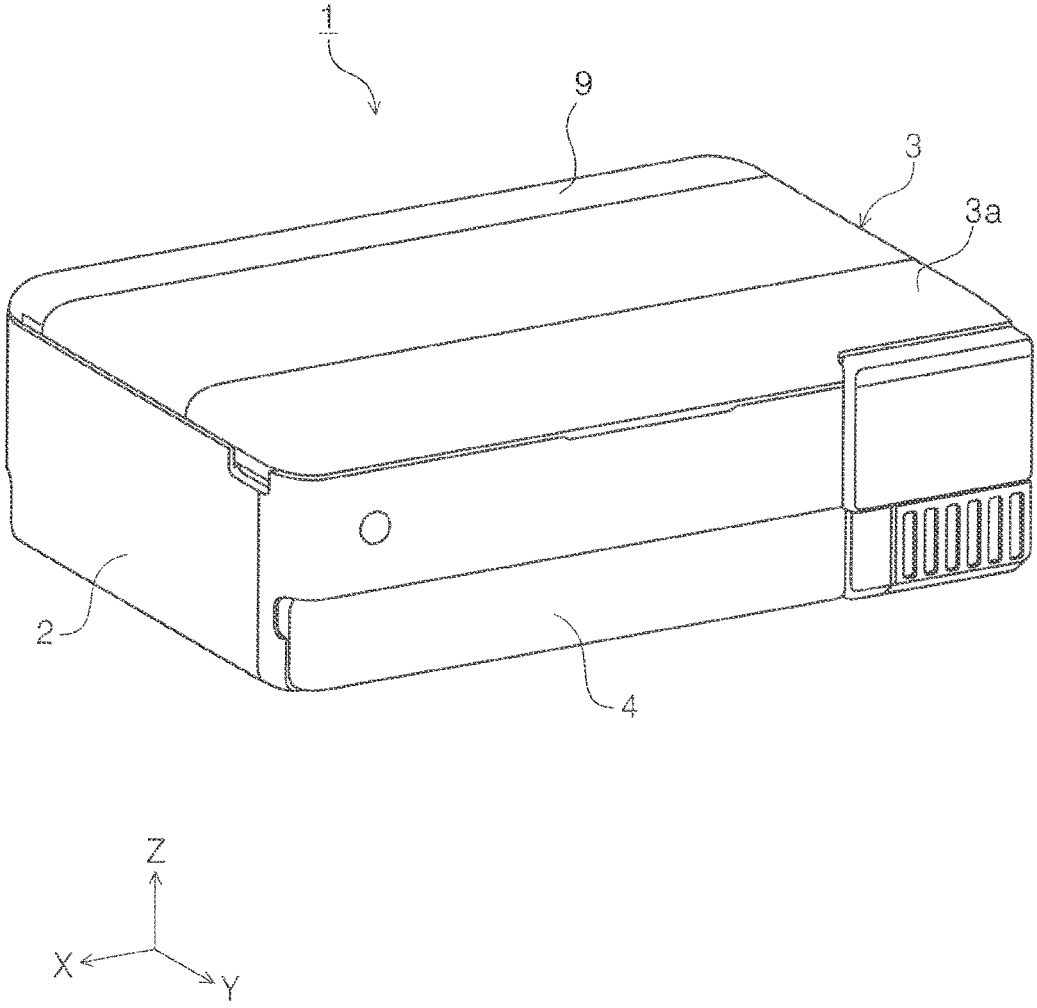
FIG. 1 is a front perspective view of a printer.

Some aspects of the present disclosure will be described below. According to a first aspect of the present disclosure, a medium support device is configured to switch between an extended state where a support surface of the medium support device which supports a medium is extended from a main body and a retracted state where the support surface of the medium support device is retracted into the main body. The main body has a processor that processes the medium. This medium support device includes: a first support section configured to transit between a first position and a second position relative to the main body; a second support section configured to transit between a position in which the second support section is retracted into the first support section and a position in which the second support section protrudes from the first support section, the second support section being supported by the first support section; and a locking mechanism configured to set a lock to the second support section. When the first support section is in the first position and the second support section is retracted into the first support section, the retracted state is formed. When the first support section is in the second position and the second support section protrudes from the first support section, the extended state is formed. The locking mechanism sets the lock to the second support section retracted into the first support section when the first support section is in the first position and, in turn, releases the lock when the first support section is in the second position.

With regard to the foregoing first aspect, a medium support device includes: a first support section; a second support section; and a locking mechanism that can set a lock to the second support section retracted into the first support section when the first support section transits to the first position and, in turn, releases the lock when the first support section transits to the second position. This locking mechanism reliably maintains the positional relationship between the first support section and the second support section at least until the first support section has transited from the first position to the second position, thereby successfully extending the first support section and the second support section in an orderly sequence. Moreover, this configuration is effective in decreasing or minimizing the retentive force by which the second support section is kept inside the first support section, compared with the configuration of FIGS. 21A and 21B, in which it is necessary to appropriately set the retentive force F2 by which the second member 102 is kept inside the first member 101 in order to extend the first member 101 and the second member 102 in an orderly sequence when the user pulls up both the first member 101 and the second member 102. This medium support device allows a user to extend the support surface at a weak operating force, thereby providing good operability for the user.

The expression "the support surface that supports a medium" herein implies that the support surface that includes at least a first support section and a second support section may have any geometry, such as a flat, uneven, or stepped shape.

The expression "the first support section is in the second position" herein implies that the first support section keeps in the second position. When the first support section is in the second position, the first support section is configured to transit between the first position and the second position second position.

According to a second aspect of the present disclosure, the medium support device of the foregoing first aspect further may further include a base that pivotably supports the first support section. This base may be displaced relative to the main body to cause the first support section to transit between the first position and the second position. The first support section may be configured to pivot relative to the base to switch between a transition attitude in which the first support section transits between the first position and the second position and a support attitude in which the first support section supports the medium. When the first support section is in the second position, the first support section may switch from the transition attitude to the support attitude to cause the locking mechanism to release the lock.

With regard to the foregoing second aspect, the first support section that has transited from the first position to the second position can switch from the transition attitude to the support attitude, thereby releasing the lock that has been set by the locking mechanism. This configuration enables a user to easily release the lock that has been set by the locking mechanism.

According to a third aspect of the present disclosure, the medium support device of the second aspect may have a configuration in which, when the first support section is the support attitude, the base supports the first support section together with a frame of the main body.

According to a fourth aspect of the present disclosure, the medium support device of the third aspect may have a configuration in which the locking mechanism includes a locking section disposed in the base. The locking section may set the lock to the second support section retracted into the first support section. The first support section, when in the second position, may switch from the transition attitude to the support attitude, with a result that the second support section moves away from the locking section to cause the locking section to release the lock.

With regard to the foregoing fourth aspect, the first support section may have a locking mechanism with a simple and low-cost configuration.

According to a fifth aspect of the present disclosure, the medium support device of the fourth aspect may have a configuration in which, while transiting between the first position and the second position, the first support section is restricted to rotating from the transition attitude to the support attitude.

With regard to the foregoing fifth aspect, while transiting between the first position and the second position, the first support section is restricted to rotating from the transition attitude to the support attitude. This configuration suppresses the lock that has been set by the locking mechanism from being accidentally released.

According to a sixth aspect of the present disclosure, the medium support device of the fourth or fifth aspect may have a configuration in which the first support section switches from the support attitude to the transition attitude while the second support section keeps protruding from the first support section. Then, when the first support section transits from the second position to the first position, the base may be warped for the locking section to set the lock to the second support section.

To retract a sheet support device into a main body, in some cases, a user may first switch a first support section from a support attitude to a transition attitude by pivoting the first support section forward with a second support section protruding from the first support section. Then, he/she may transit the first support section from a second position to a first position. Those irregular operations would cause a part of the second support section to which the locking section has set the lock to collide against the locking section. As a result, he/she might be unable to retract the second support section into the first support section and damage the locking section.

In the foregoing sixth aspect, however, the base is flexibly warped, thereby causing the part of the second support section to which the locking section has set the lock to move beyond the locking section. Therefore, regardless of whether the above irregular operations are performed or not, the medium support device enables a user to reliably switch from the extended state to the retracted state with minimal risk of damaging the locking section.

According to a seventh aspect of the present disclosure, the medium support device of the sixth aspect may further include a third support section that is configured to transit between a position in which the third support section is retracted into the second support section and a position in which the third support section protrudes from the second support section, the third support section being supported by the second support section. The locking mechanism may be configured to set a lock to the third support section. The locking mechanism may set the lock to the third support section retracted into the second support section when the first support section transits to the first position and, in turn, may release the lock when the first support section transits to the second position.

With regard to the foregoing seventh aspect, the configuration with the third support section produces substantially the same as that of the foregoing sixth aspect.

According to an eighth aspect of the present disclosure, the medium support device of the seventh aspect may further include: a second support retainer that keeps a state where the second support section protrudes from the first support section; and a third support retainer that keeps a state where the third support section protrudes from the second support section. The second support retainer may include a first coupler and a second coupler, the first coupler being disposed in one of the first support section and the second support section, the second coupler being disposed in the other of the first support section and the second support section, the second coupler being kept in contact with the first coupler by an elastic force. The third support retainer may include a third coupler and a fourth coupler, the third coupler being disposed in one of the second support section and the third support section, the fourth coupler being disposed in the other of the second support section and the third support section, the fourth coupler being kept in contact with the third coupler by an elastic force. The second support section may be guided at both edges in a width direction by the first support section, the width direction intersecting a direction in which the medium is to be fed. The third support section may be guided at both edges in the width direction by the second support section. A distance in the width direction between the third support retainer and a location at which the third support section is guided by the second support section may be set to be shorter than a distance between the second support retainer and a location at which the second support section is guided by the first support section.

Suppose a retainer that includes: a first coupler; and a second coupler which is kept in contact with the first coupler by an elastic force is provided in a sheet support device to keep one support section protruding from another support section. When these support sections are warped in the directions in which two couplers move away from each other, the retentive force therebetween deceases, thereby hindering the retainer from keeping the one support section protruding from the other support section. This disadvantage tends to arise especially in a third support section that protrudes more than a second support section because it is more difficult to ensure the stiffness of the third support section than that of the second support section.

Support sections provided in a sheet support device are more likely to be warped at the edges in the width direction, or at the guided locations, than at the center. With regard to the foregoing eighth aspect, a distance in the width direction between the third support retainer and a location at which the third support section is guided by the second support section is set to be shorter than a distance between the second support retainer and a location at which the second support section is guided by the first support section. This configuration reliably ensures the retentive force by which the third support section is kept protruding from the second support section.

According to a ninth aspect of the present disclosure, a recording apparatus includes: a recording head that performs a record operation on a medium, the recording head acting as the processor; and the medium support device according to one of the first to eight aspects that supports a medium to be fed to the recording head.

With regard to the foregoing ninth aspect, the recording apparatus produces substantially the same effect as any of the first to eight aspects.

According to a tenth aspect of the present disclosure, the recording apparatus of the foregoing ninth aspect may have a configuration in which the medium support device is disposed on a rear surface of the recording apparatus to form a portion of the rear surface of the recording apparatus.

Some embodiments of the present disclosure will be described below with reference to the accompanying drawings. In the individual drawings, the X-axis is parallel to the width of an ink jet printer 1, and it is also perpendicular to the direction in which a paper sheet, which is an example of a medium, is to be transported, or is parallel to the width of the paper sheet. When a user stands facing the ink jet printer 1, the +X direction coincides with his/her left direction, whereas the −X direction coincides with his/her right direction. The Y-axis is parallel to the depth of the ink jet printer 1. The +Y direction is a direction from a rear surface of the ink jet printer 1 to a front surface of the ink jet printer 1, whereas the −Y direction is a direction from the front surface to the rear surface. The ink jet printer 1 ejects a processed paper sheet to the outside via an outlet 17 (see FIG. 3) in the +Y direction. In this embodiment, of the individual exterior surfaces of the ink jet printer 1, one with a front cover 4 is the front surface. The Z-axis is parallel to the height of the ink jet printer 1. The +Z direction is an upward direction in the vertical direction, whereas the −Z direction is a downward direction in the vertical direction. Hereinafter, the direction in which a paper sheet is to be transported is defined as the downstream direction, whereas the opposite direction is defined as the upstream direction.

Figure 2:
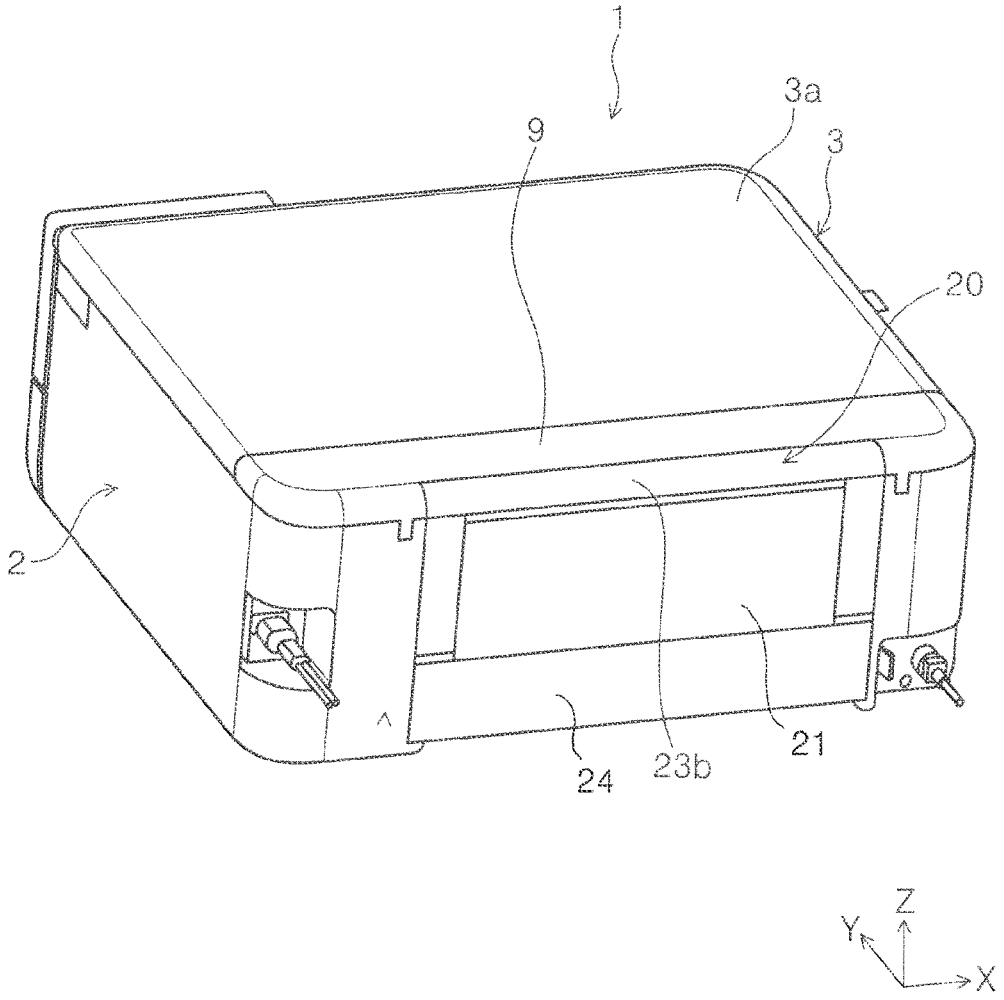
FIG. 2 is a rear perspective view of the printer.
Figure 3:
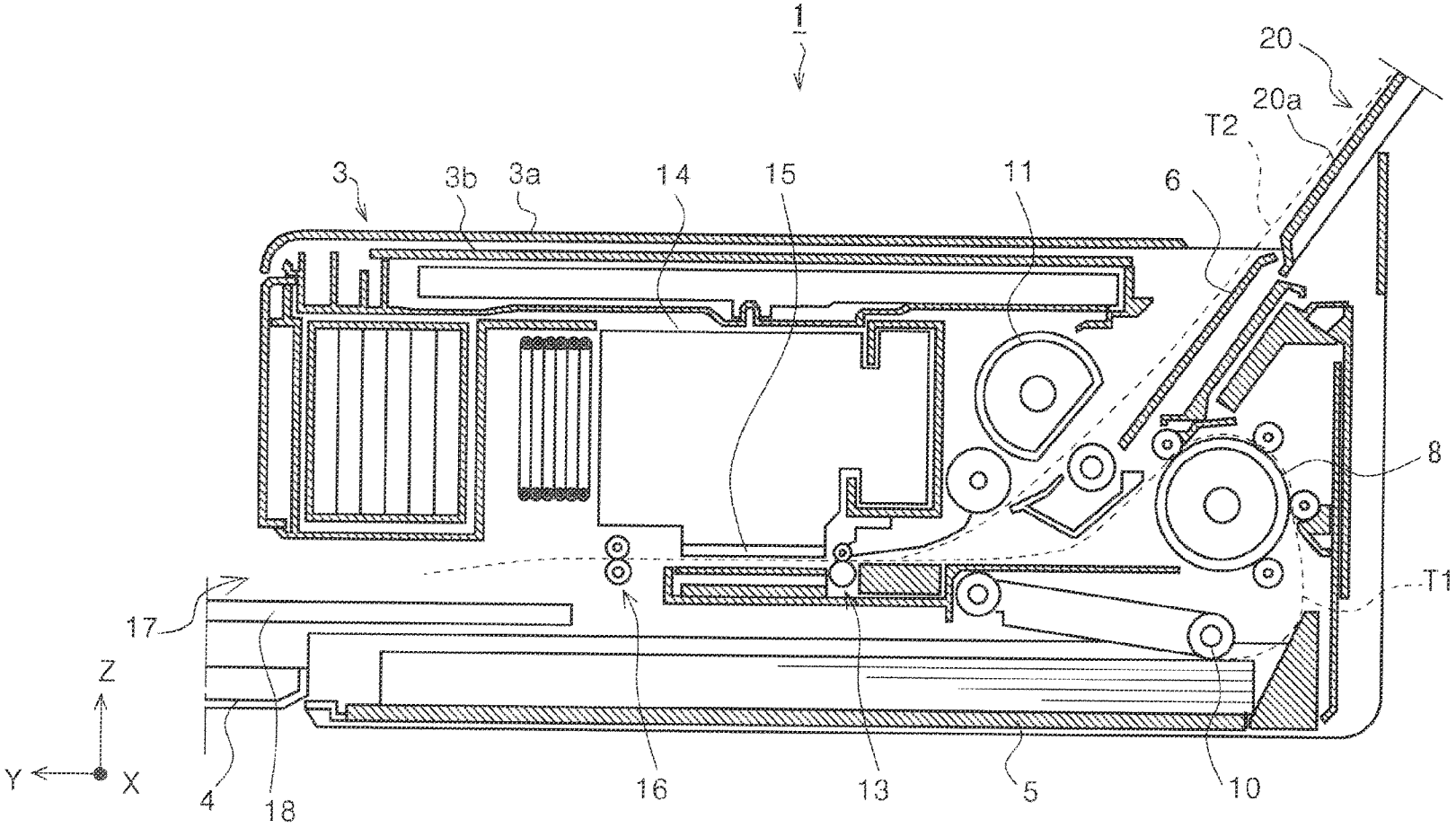
FIG. 3 illustrates a paper-sheet transport route in the printer.

As illustrated in FIGS. 1 to 3, the ink jet printer 1 includes: a main body 2; and a scanning section 3 disposed in an upper portion of the main body 2. The ink jet printer 1, which may be a multi-function printer (MFP), is an example of a recording apparatus herein and referred to below as the printer 1 for the sake of convenience. The scanning section 3 is pivotable relative to the main body 2 and can be set to two states: a closed state (see FIG. 1) and an open state (not illustrated). The scanning section 3 includes a sheet cover 3*a* that hides a platen 3*b* (see FIG. 3) from the outside or exposes the platen 3*b* (see FIG. 3) thereto.

The printer 1 further includes an upper cover 9 disposed on the top of the main body 2 and behind the sheet cover 3*a*. The printer 1 allows a user to open the upper cover 9 and then to pull up and extend a sheet support device 20 (see FIG. 3) so that he/she can place a paper sheet on both a hopper 6 and the sheet support device 20, as illustrated in FIG. 3. Herein, the sheet support device 20 is an example of a medium support device. When the user places a paper sheet on both the hopper 6 and the sheet support device 20, the printer 1 elevates the hopper 6 until it abuts against a second sheet-feeding roller 11 and then rotates the second sheet-feeding roller 11, thereby transporting this paper sheet in the downstream direction. In FIG. 3, a dotted line denoted by T2 indicates the route along which the paper sheet is to be transported by the second sheet-feeding roller 11.

The printer 1 further includes the front cover 4 on a front lower portion of the main body 2; the front cover 4 is configured to pivot about the front edge of a lower sheet-feeding tray 5 disposed on the bottom of the main body 2 and can be set to two states: a closed state (see FIG. 1) and an open state (see FIG. 3). The printer 1 allows the user to open the front cover 4, as illustrated in FIG. 3, so that the outlet 17 through which a processed paper sheet is to be transported and a sheet reception tray 18 to which the paper sheet is to ejected via the outlet 17 are exposed. The printer 1 can transmit power from a motor (not illustrated) to the sheet reception tray 18, setting the sheet reception tray 18 to two states: a first state in which the sheet reception tray 18 is retracted into the main body 2 and a second state in which the sheet reception tray 18 protrudes from the main body 2.

Details of the paper sheet transport route will be described below with reference to FIG. 3. First, a paper sheet placed in the lower sheet-feeding tray 5 that is disposed inside the main body 2 near the bottom is fed in the −Y direction by a first sheet-feeding roller 10. In FIG. 3, the route along which the paper sheet is transported from the lower sheet-feeding tray 5 is denoted by T1. After fed from the lower sheet-feeding tray 5 or the hopper 6, the paper sheet receives a feeding force from an inversely-rotating roller 8 disposed above the first sheet-feeding roller 10 and fed to a transport roller pair 13, which is disposed adjacent to the inversely-rotating roller 8 in the +Y direction. Then, the paper sheet is fed by the transport roller pair 13 to a recording area defined opposite a recording head 15.

After fed to the recording area, the paper sheet is processed by ink that the recording head 15 disposed inside a carriage 14 discharges during the reciprocating of the carriage 14 in the ±X directions by means of power from a power source (not illustrated). Herein, the recording head 15 is an example of a processor. Then, the processed paper sheet is ejected to the sheet reception tray 18 via the outlet 17 by an ejection roller pair 16.

Figure 14:
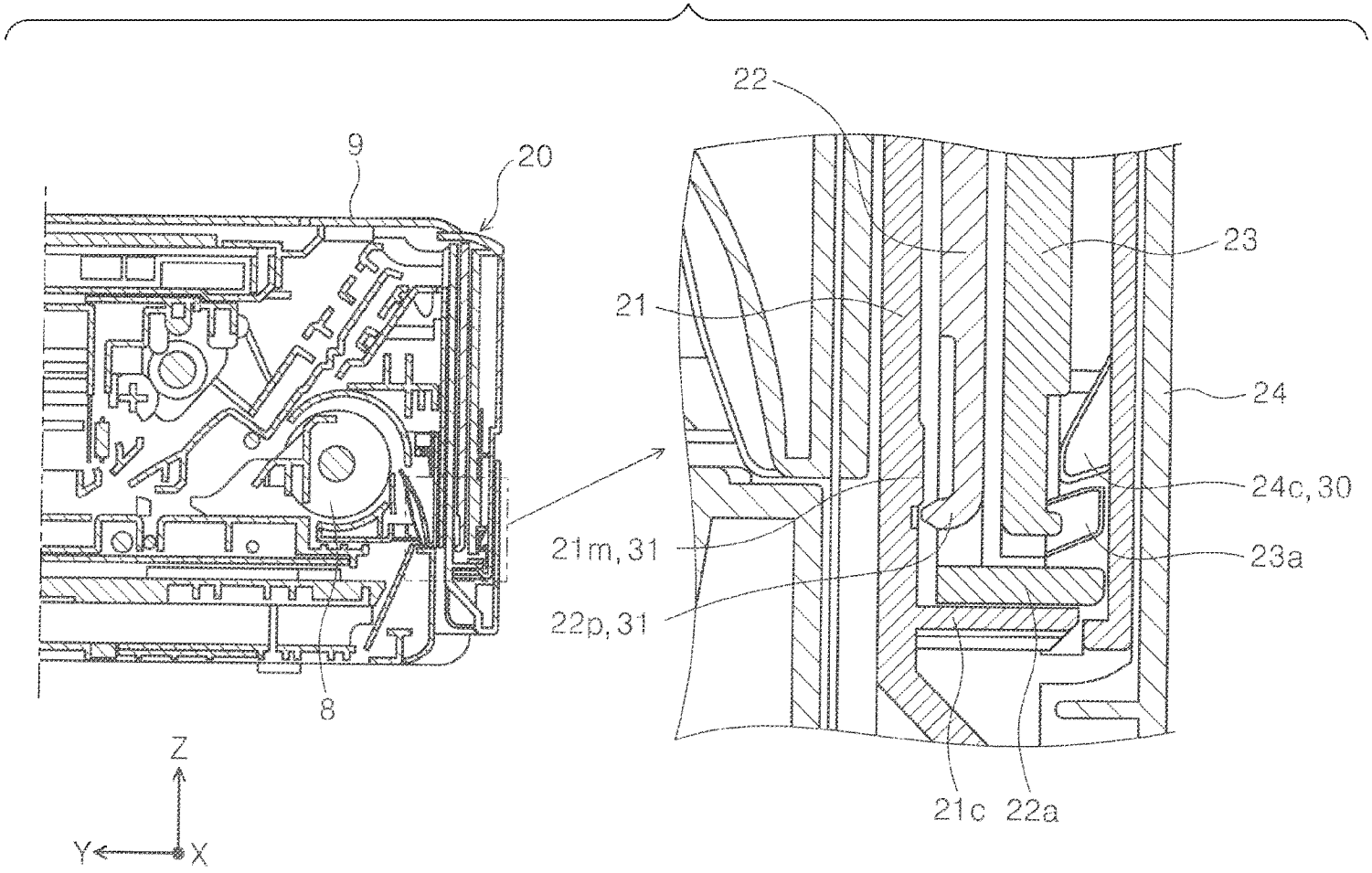
FIG. 14 is a partial cross-sectional view of a first retainer and surrounding components in the sheet support device.
Figure 15:
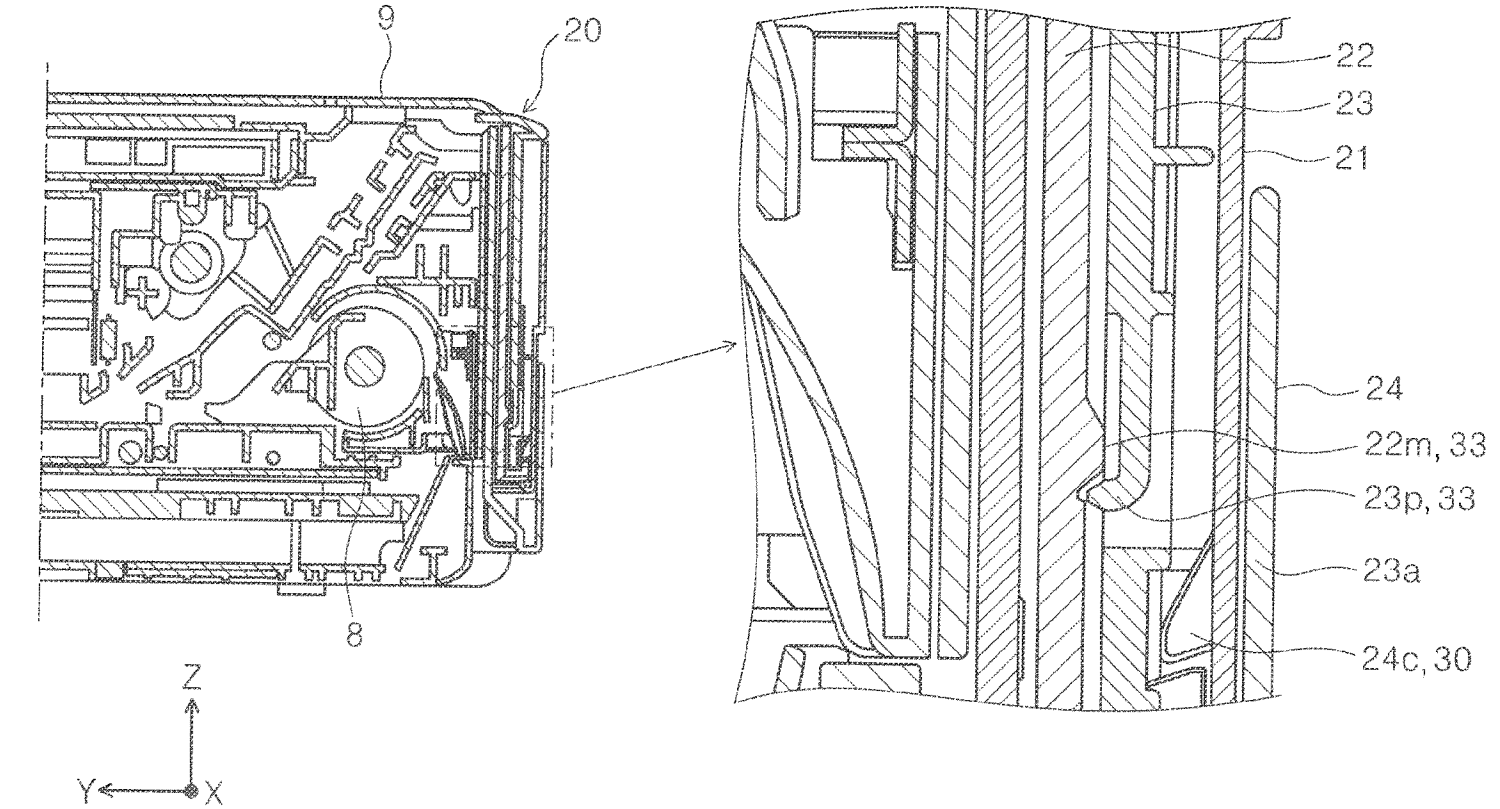
FIG. 15 is a partial cross-sectional view of a third retainer and surrounding components in the sheet support device.
Figure 16:
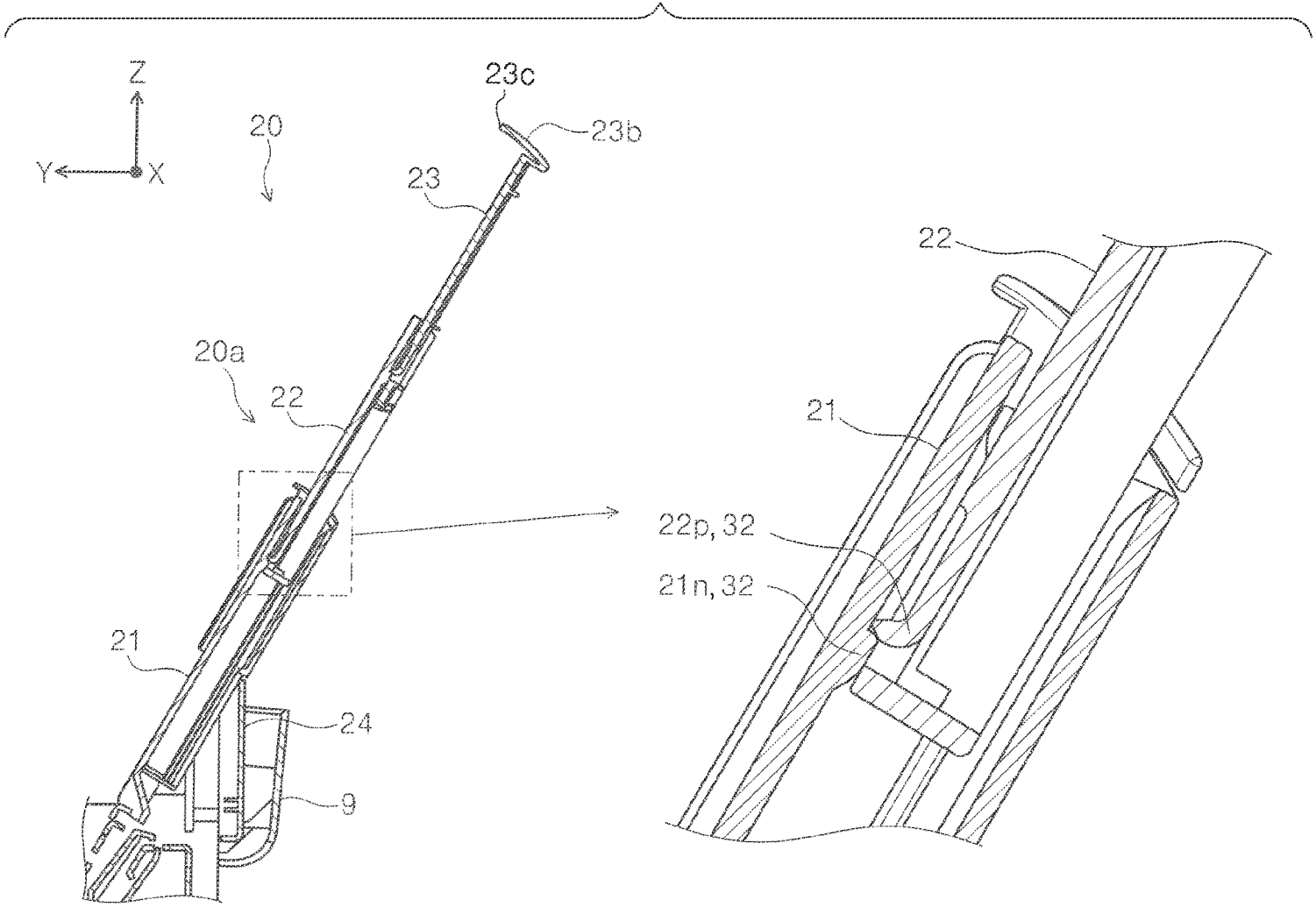
FIG. 16 is a partial cross-sectional view of a second retainer and surrounding components in the sheet support device.
Figure 17:
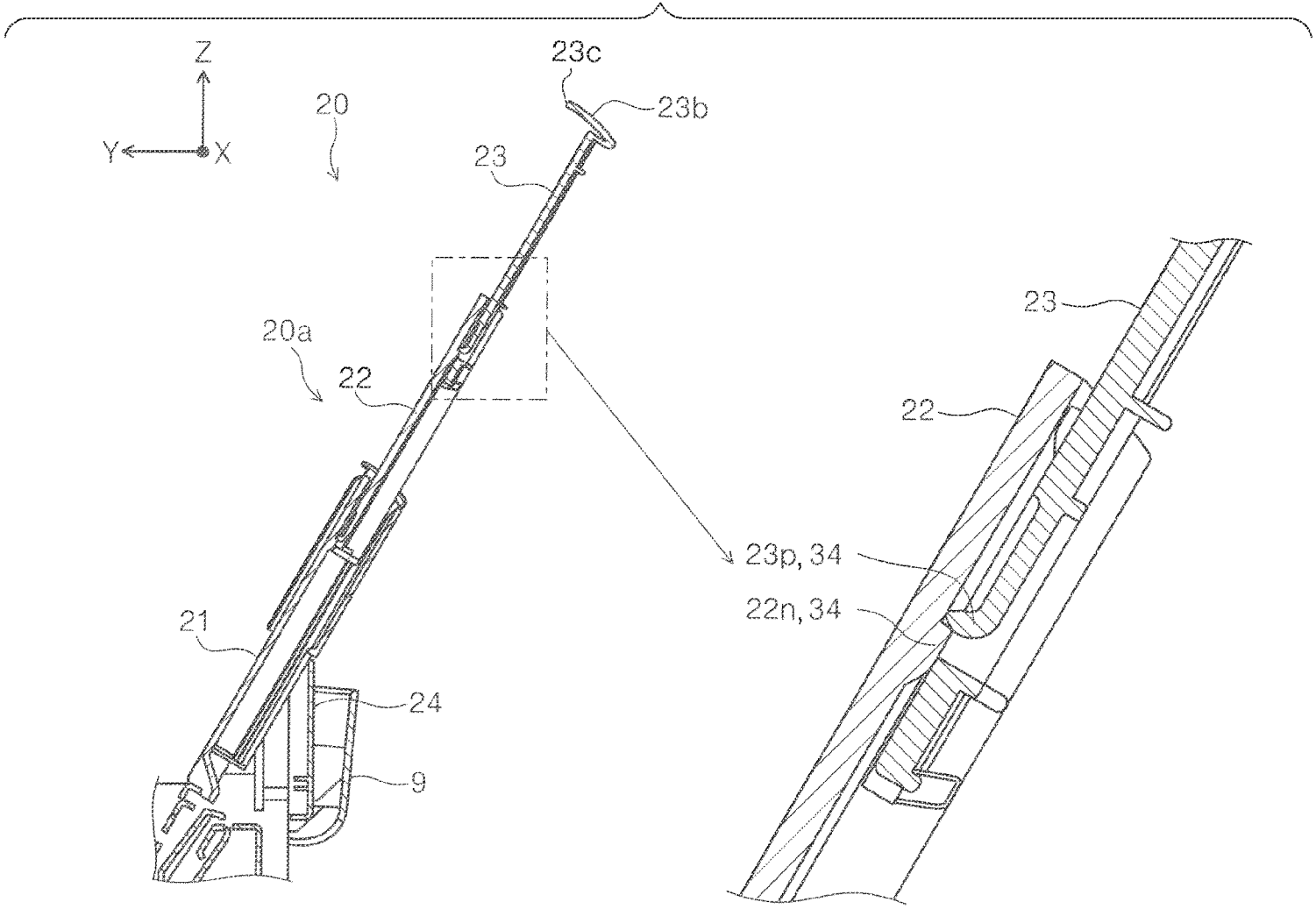
FIG. 17 is a partial cross-sectional view of a fourth retainer and surrounding components in the sheet support device.

Next, a description will be given below in detail of the sheet support device 20 disposed in a rear portion of the main body 2. FIGS. 11A, 11B, 13A, and 13B are each a cross-sectional view of the sheet support device 20 as viewed from the +X direction, more specifically the Y-Z plane of the sheet support device 20 in FIG. 18 at a location X1. FIGS. 14 and 16 are each a cross-sectional view of the sheet support device 20 as viewed from the +X direction, more specifically the Y-Z plane of the sheet support device 20 in FIG. 18 at a location X2. FIGS. 15 and 17 are each a cross-sectional view of the sheet support device 20 as viewed from the +X direction, more specifically the Y-Z plane of the sheet support device 20 in FIG. 18 at a location X3.

Figure 4:
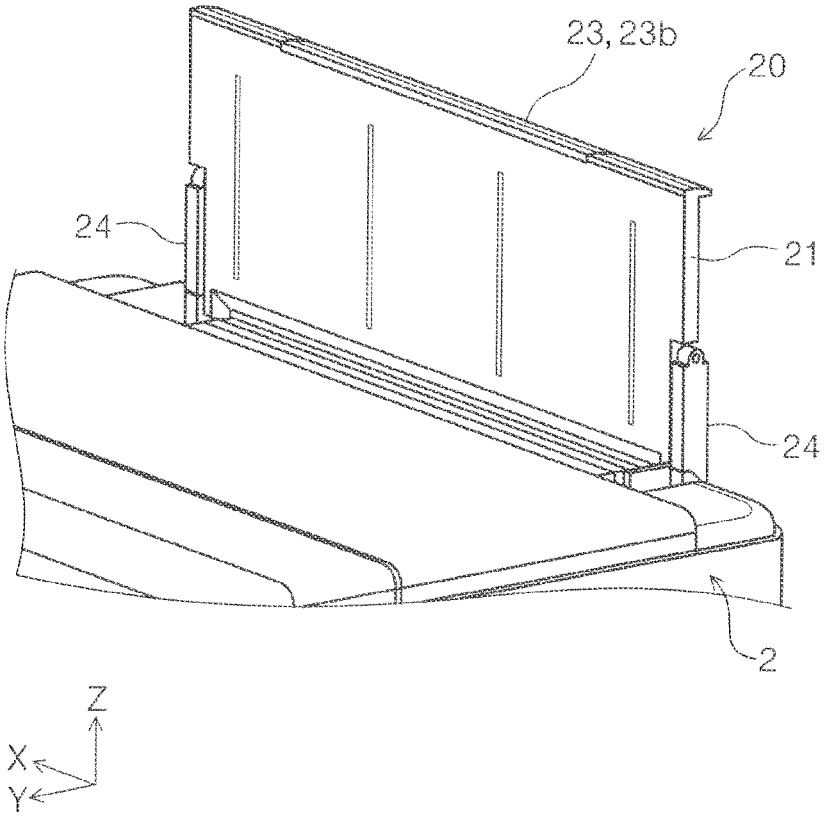
FIG. 4 is a front perspective view of the sheet support device when a first support section has been transited to a second position and switched to a transition attitude.
Figure 5:
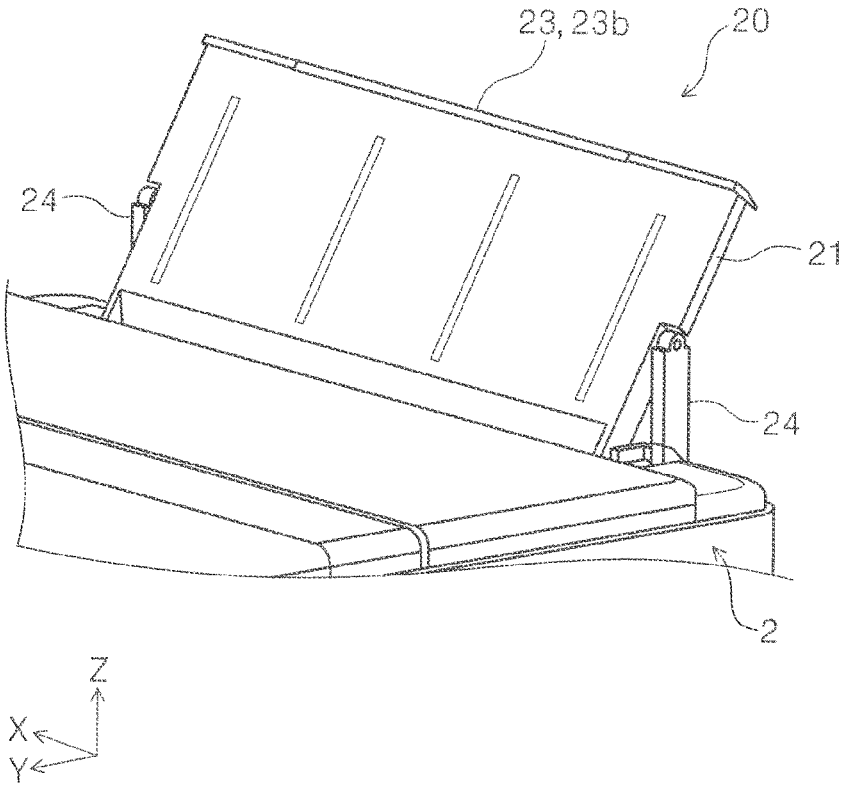
FIG. 5 is a front perspective view of the sheet support device when the first support section has been transited to the second position and switched to a support attitude.
Figure 6:
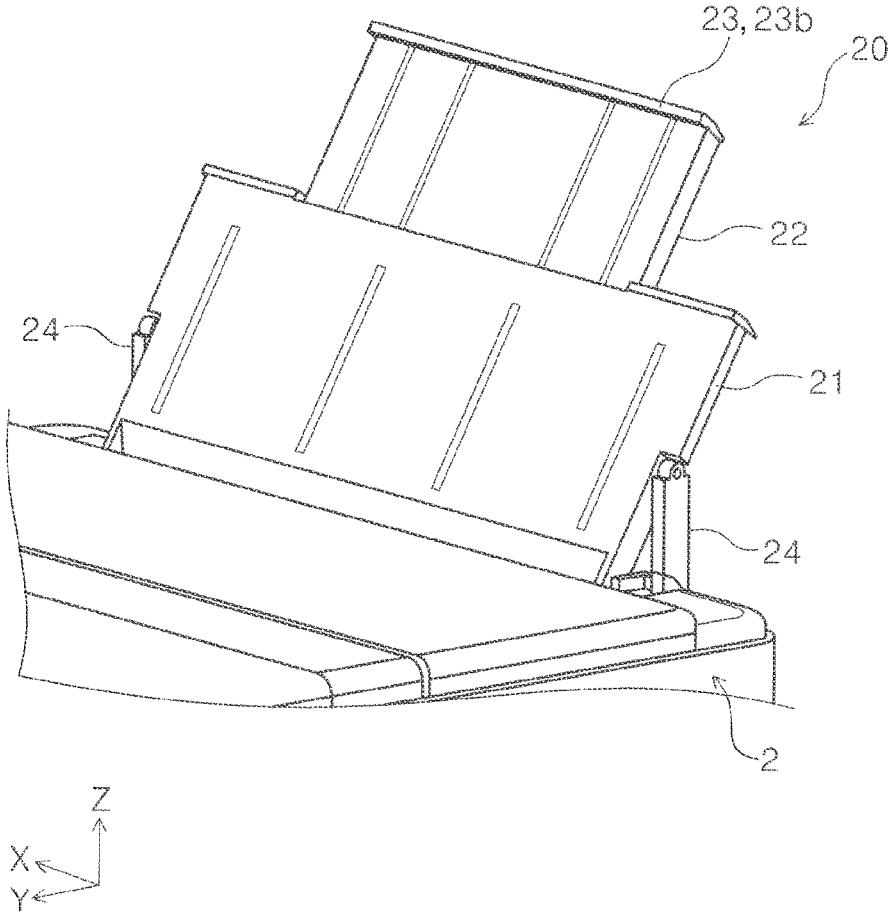
FIG. 6 is a front perspective view of the sheet support device when the second support section protrudes from the first support section.
Figure 7:
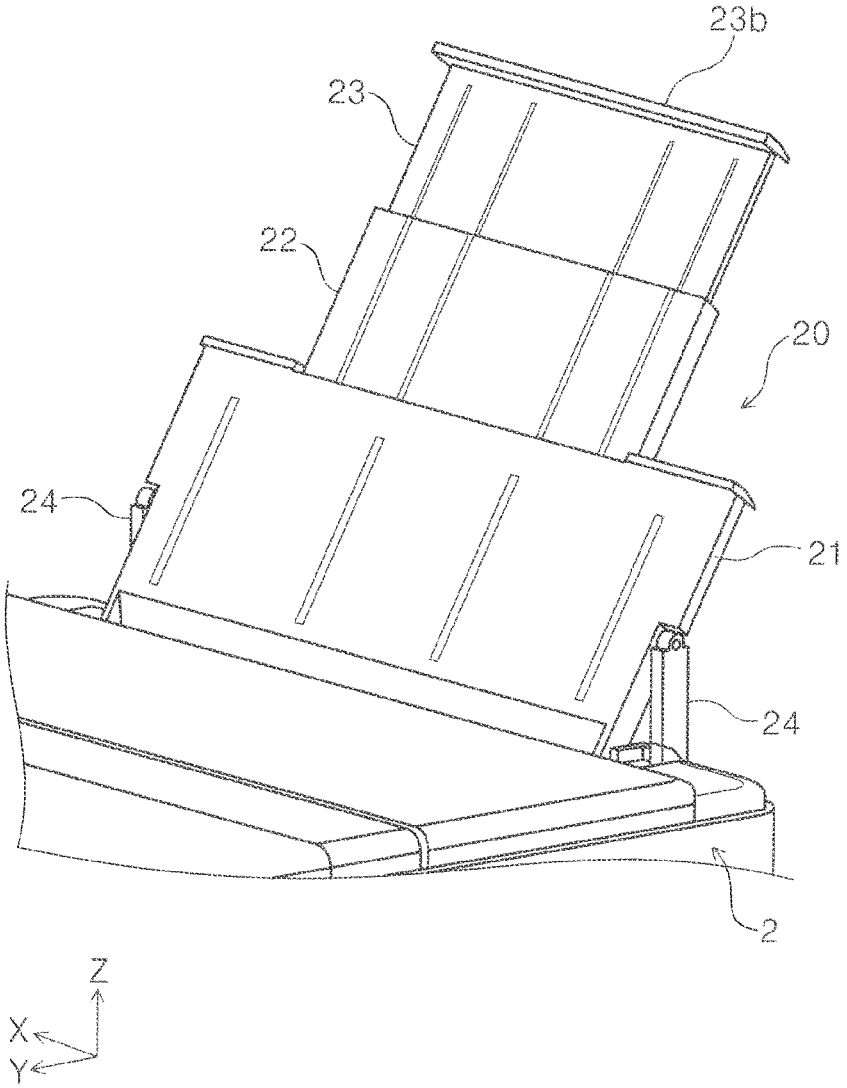
FIG. 7 is a front perspective view of the sheet support device in an extended state where a third support section protrudes from the second support section.
Figure 8:
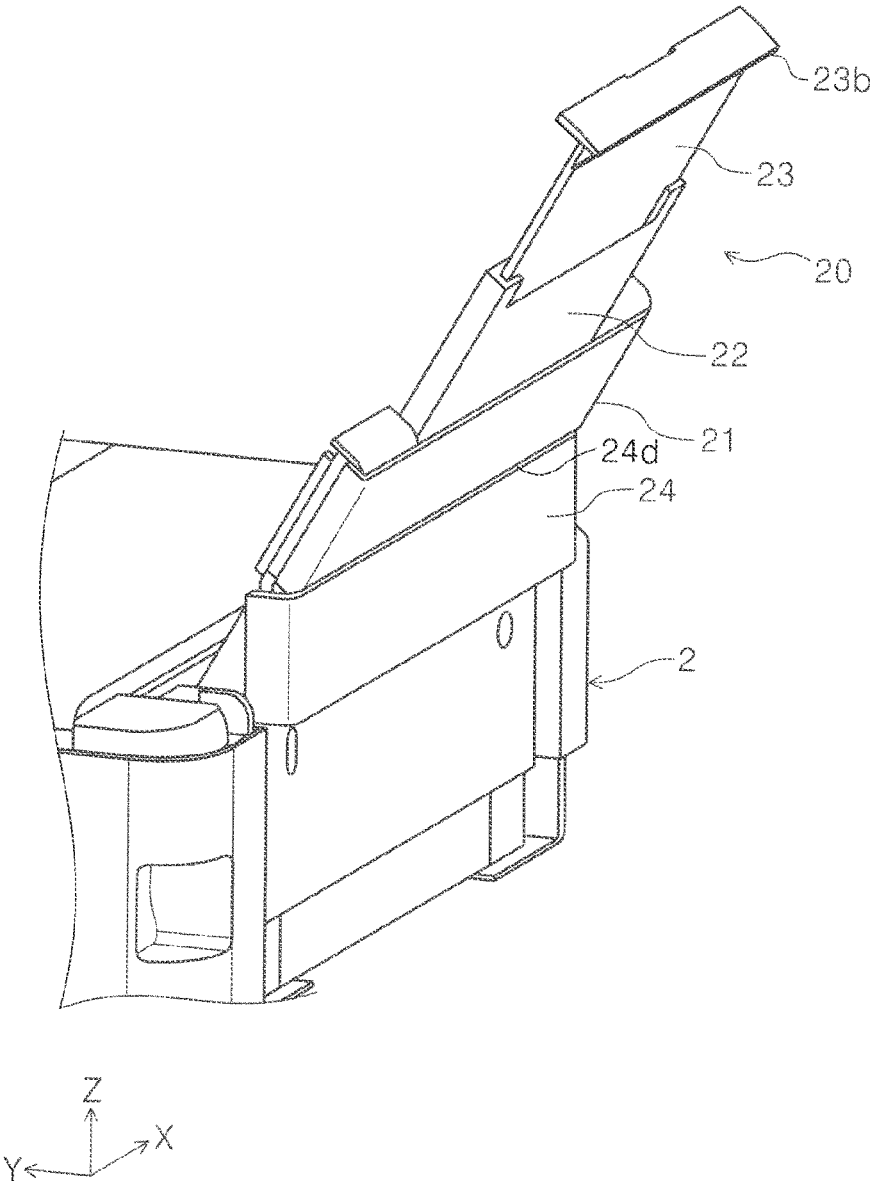
FIG. 8 is a rear perspective view of the sheet support device in the extended state where the third support section protrudes from the second support section.

The sheet support device 20 can be switched between two states: an extended state in which a support surface 20*a* that supports a paper sheet is extended (see FIGS. 3, 7, 8, 16, and 17) from the main body 2 and a retracted state in which the support surface 20*a* is retracted into the main body 2 (see FIGS. 1, 2, 14, and 15). When in the retracted state, the sheet support device 20 forms a portion of the rear surface of the main body 2, as illustrated in FIG. 2. In this embodiment, the sheet support device 20 may be switched between the extended state and the retracted state in accordance with a user's operation. FIGS. 4, 5, and 6 each illustrate the process in which the sheet support device 20 is switched to the extended state. As illustrated in FIG. 5 or 6, the sheet support device 20 can support a paper sheet having a predetermined size even when not fully extended.

The sheet support device 20 includes a first support section 21 that forms a portion of the support surface 20*a*. The first support section 21 can transit between a first position and a second position relative to the main body 2. In FIG. 2, the first support section 21 is in the first position, whereas in FIG. 4, the first support section 21 is in the second position. When in the second position, the first support section 21 is configured to transit from one attitude to another, details of which will be described later. However, when "the first support section 21 is in the second position"

as described later, the first support section 21 may have any given attitude. Herein, both of the first position and the second position are associated with a vertical location of components, especially rotation shaft 21*a* (see FIG. 9 and described later), of the first support section 21. More specifically, when the rotation shaft 21*a* is disposed at the lowest location, the first support section 21 is in the first position. When the rotation shaft 21*a* is disposed at the highest location, the first support section 21 is in the second position.

The sheet support device 20 further includes a second support section 22 that is supported by the first support section 21 and forms a portion of the support surface 20*a*. The second support section 22 can transit between a retracted position in which the second support section 22 is retracted into the first support section 21 and a protruding position in which the first support section 21 protrudes from the first support section 21. In FIGS. 4 and 5, the second support section 22 is in the retracted position, whereas in FIG. 6, the second support section 22 is in the protruding position.

The sheet support device 20 further includes a third support section 23 that is supported by the second support section 22 and that forms a portion of the support surface 20*a*. The third support section 23 can transit between a retracted position in which the third support section 23 is retracted into the second support section 22 and a protruding position in which the third support section 23 protrudes from the second support section 22. In FIGS. 5 and 6, the third support section 23 is in the retracted position, whereas in FIG. 7, the third support section 23 is in the protruding position.

The sheet support device 20 further includes a base 24 that rotatably supports the first support section 21. The base 24 moves relative to the main body 2, thereby transiting the first support section 21 between the first position and the second position. The base 24 allows the first support section 21 to pivot relative to the base 24, thereby switching the first support section 21 between a transition attitude in which the first support section 21 is being transited from the first position to the second position or from the second position to the first position and a support attitude in which the first support section 21 supports a paper sheet. In FIG. 4, the first support section 21 is in the transition attitude, whereas in FIG. 5, the first support section 21 is in the support attitude.

Next, a description will be given of an operation of switching the sheet support device 20 from the retracted state to the extended state. The sheet support device 20 allows the user to open the upper cover 9 that partly covers the upper surface of the main body 2 as illustrated in FIG. 2 and then to switch from the retracted state to the extended state. Optionally, when opened, the upper cover 9 provides a retentive force by which the upper cover 9 is kept to close the main body 2 in order to give a click feeling to the user. This configuration can reduce the risk of the upper cover 9 accidentally opened and, moreover, the sheet support device 20 accidentally extended when the printer 1 is in a slanting position. In FIGS. 4 to 8, the upper cover 9 is removed for the sake of convenience.

In this embodiment, when in the retracted state, the sheet support device 20 is fully retracted into the rear portion of the main body 2 in an upright attitude, as illustrated in FIGS. 14 and 15. The upright attitude of the first support section 21 in this embodiment corresponds to the transition attitude. The position in which the first support section 21 has when the sheet support device 20 is in the retracted state corresponds to the first position.

The sheet support device 20 further includes a gripper 23*b* as a portion of the third support section 23, which is disposed on the top of the main body 2 when the sheet support device 20 is in the retracted state. The gripper 23*b* helps the user pull up the third support section 23 substantially vertically after he/she opens the upper cover 9.

Figure 9:
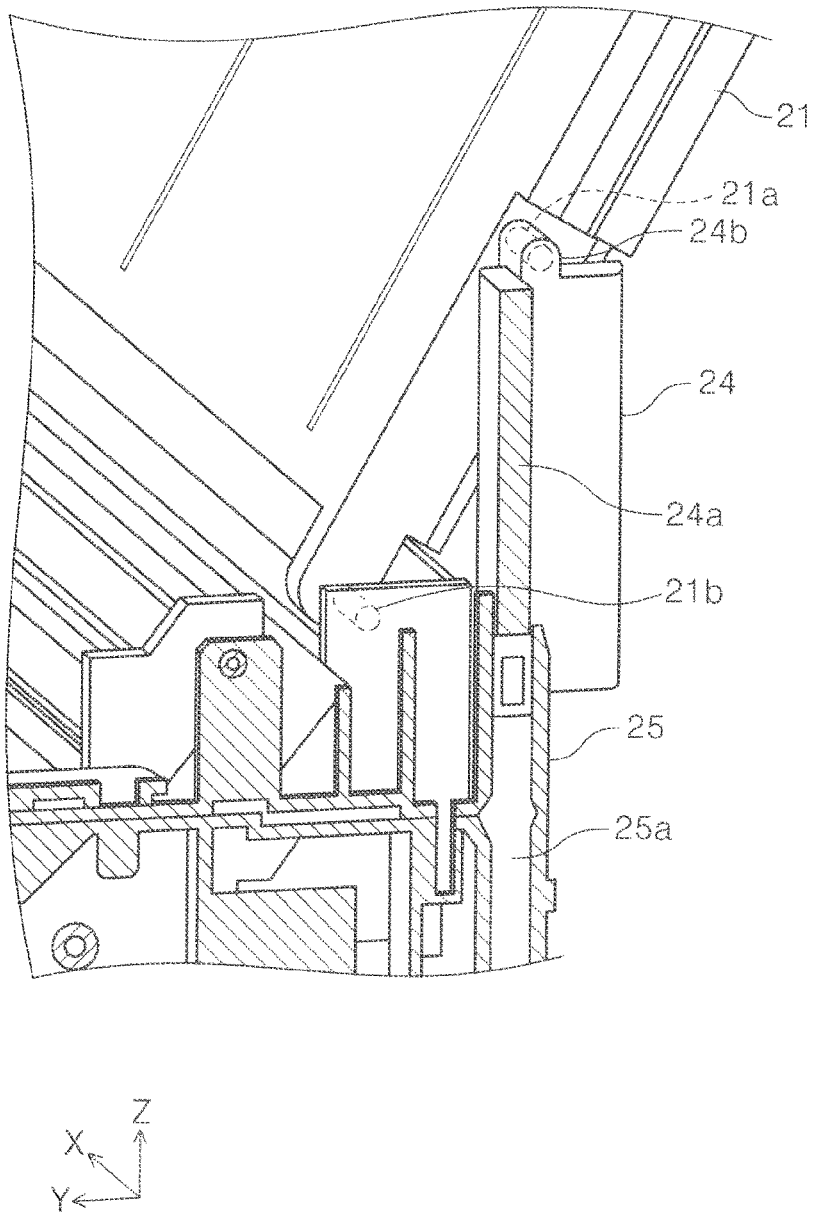
FIG. 9 is a partial cross-sectional view of the base and the frame in the sheet support device.

As illustrated in FIG. 9, the sheet support device 20 further includes a frame 25 that forms the main body 2. The frame 25 has first guide grooves 25*a* formed straightly and vertically into which respective guided sections 24*a* formed in the base 24 are inserted. The rotation shaft 21*a* of the first support section 21 is supported by bearings 24*b* of the base 24. This configuration allows the user to rotate the first support section 21 around an axis parallel to the X-axis.

As illustrated in FIGS. 16 and 17, the gripper 23*b* has a flange 23*c* that protrudes from the support surface 20*a*. When a large-sized paper sheet is placed on the support surface 20*a*, the flange 23*c* suppresses the paper sheet from sticking out of the upper edge of the support surface 20*a* and being curled down.

Figure 10A:
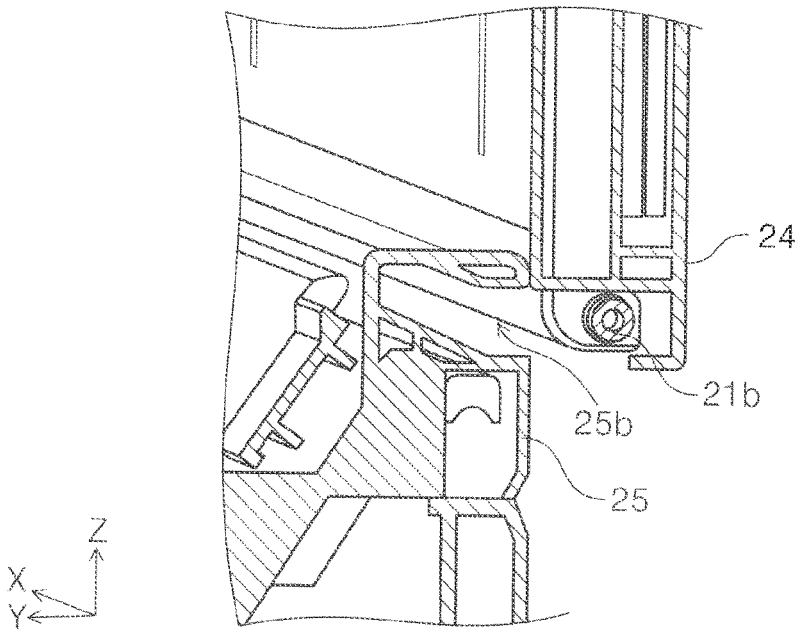
FIG. 10A is a partial cross-sectional view of the base and the frame when the first support section is being switched from the first position to the second position.
Figure 10B:
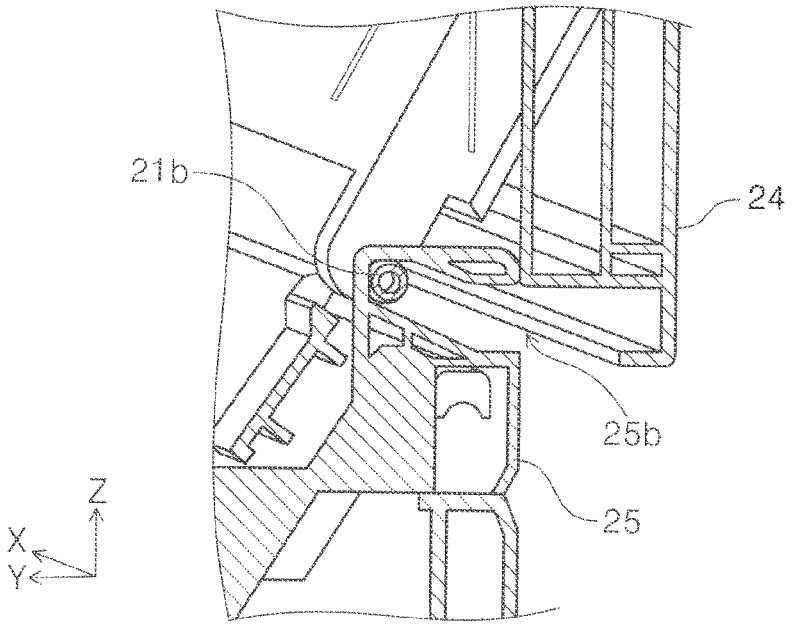
FIG. 10B is a partial cross-sectional view of the base and the frame after the first support section is switched to the second position.

As illustrated in FIGS. 10A and 10B, the first support section 21 has bosses 21*b* that protrudes in the ±X direction. The bosses 21*b* are inserted into the respective first guide grooves 25*a* (see FIG. 9). It should be noted that, although FIGS. 9 and 10 each illustrate only the configuration of the sheet support device 20 on the −X-side, the sheet support device 20 has substantially the same configuration on the +X-side. Therefore, the frame 25 guides the base 24 on its ±X sides. In addition, the base 24 rotatably supports the first support section 21 on its ±X sides.

When the user pulls up the gripper 23*b*, the first support section 21, the second support section 22, the third support section 23, and the base 24 integrally move upward, as illustrated in FIG. 4. In this case, the position of the first support section 21 corresponds to the second position.

When the first support section 21 is transiting from the first position to the second position, both the bosses 21*b* do not face a second guide groove 25*b*, formed along the Y-axis, of the frame 25 as illustrated in FIG. 10A, thereby restricting the first support section 21 to rotating around the rotation shaft 21*a*. After the first support section 21 has transited to the second position, both the bosses 21*b* face the second guide groove 25*b* as illustrated in FIG. 10B, thereby permitting the first support section 21 to rotate around the rotation shaft 21*a* and thus to be switched from the transition attitude (see FIG. 4) to the support attitude (see FIG. 5). In short, the support attitude of the first support section 21 is formed by the base 24 that supports the rotation shaft 21*a* and the frame 25 against which both the bosses 21*b* abut. Likewise, the transition attitude of the first support section 21 is formed by the base 24 that supports the rotation shaft 21*a* and the first guide groove 25*a*, or the frame 25, into which the bosses 21*b* are inserted. On the other hand, when in the second position, the first support section 21 can be switched from the support attitude (see FIG. 5) to the transition attitude (see FIG. 4). In addition to a part that supports the rotation shaft 21*a*, the base 24 may further include an upper side 24*d* (see FIG. 8) that is in contact with the first support section 21 and supports the rear portion of the first support section 21.

After the first support section 21 is switched to the support attitude (see FIG. 5), the sheet support device 20 allows the user to diagonally pull up the gripper 23*b* to transit the second support section 22 to the protruding position, in which the second support section 22 protrudes from the first support section 21 (see FIG. 6). Furthermore, the sheet support device 20 allows the user to further diagonally pull up the gripper 23*b* to transit the third support section 23 to the protruding position, in which the third support section 23 protrudes from the second support section 22 (see FIG. 8). Through those operations, the sheet support device 20 is switched to the extended state.

The above operations of the sheet support device 20 will be described again from the viewpoint of the first support section 21 and the second support section 22. The first support section 21 is in the first position and the second support section 22 is retracted into the first support section 21, with the result that the retracted state of the sheet support device 20 is formed. The first support section 21 is in the second position and the second support section 22 protrudes from the first support section 21, with the result that the extended state of the sheet support device 20 is formed.

The sheet support device 20 allows the user to switch from the extended state to the retracted state through the above operations in the reverse sequence. More specifically, the sheet support device 20 in the extended state (see FIGS. 7 and 8) allows the user to diagonally pull down the third support section 23 to transit the third support section 23 to the retracted position, in which the third support section 23 is retracted into the second support section 22 (see FIG. 6). Furthermore, the sheet support device 20 allows the user to further diagonally pull down the third support section 23 to transit the second support section 22 from the protruding state (see FIG. 6) to the retracted position, in which the second support section 22 is retracted into the first support section 21 (see FIG. 5). In this state, the sheet support device 20 allows the user to pivot the first support section 21 forward to transit the first support section 21 from the support attitude (see FIG. 5) to the transition attitude (see FIG. 4). Moreover, the sheet support device 20 allows the user to pull down the first support section 21 to integrally retract the first support section 21, the second support section 22, the third support section 23, and the base 24 into the main body 2. In this way, the sheet support device 20 is switched to the retracted state (see FIGS. 2, 14, and 15).

Next, a description will be given of a mechanism for achieving the above extended and retracted behaviors of the sheet support device 20. In response to a user's pull-up operation of the sheet support device 20 with the gripper 23*b*, the first support section 21, the second support section 22, the third support section 23, and the base 24 are integrally displaced upward, as described above. This behavior is realized by a locking mechanism 30. Further, when the first support section 21 transits to the first position, the locking mechanism 30 sets a lock to both the second support section 22 and the third support section 23 in the retracted position, in which they are retracted into the first support section 21. Then, when the first support section 21 transits to the second position, the locking mechanism 30 releases the lock to both the second support section 22 and the third support section 23.

Figure 11A:
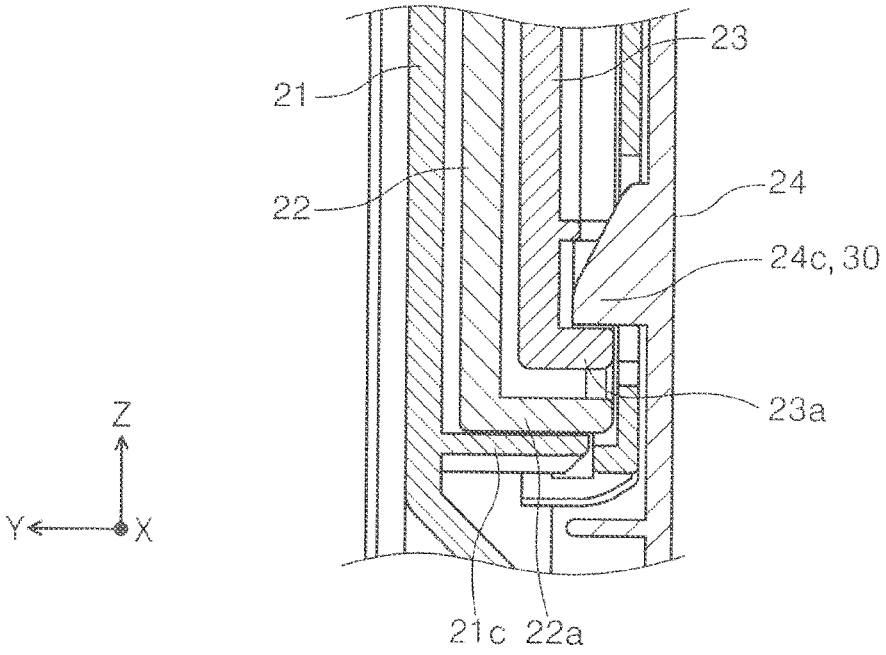
FIG. 11A is a partial cross-sectional view of the locking section and surrounding components when the sheet support device is in the transition attitude.
Figure 11B:
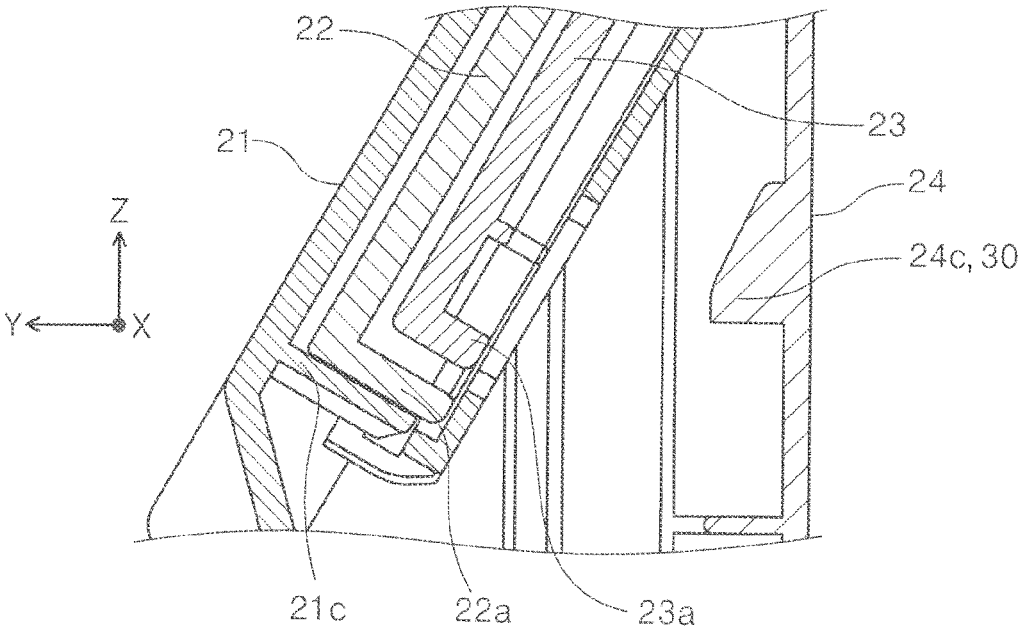
FIG. 11B is a partial cross-sectional view of the locking section and the surrounding components when the sheet support device is in the support attitude.

As illustrated in FIGS. 11A and 11B, the locking mechanism 30 includes a locking section 24*c* that protrudes from the base 24. The locking section 24*c* has an inclined surface on the +Z-side, and also has a surface extending in the +Y direction on the −Z-side when the sheet support device 20 is in the retracted state. The locking section 24*c* is formed on the base 24 at the center in the +X direction (not illustrated). However, the structure of the locking mechanism 30, more specifically the locking section 24*c* is not limited: any number of locking sections 24*c* may be formed thereon at appropriate locations in the +X direction.

As illustrated in FIGS. 11A and 11B, the third support section 23 has a third abutment section 23*a* on the −Z-side; the second support section 22 has a second abutment section 22*a* on the −Z-side; and the first support section 21 has a first abutment section 21*c* on the −Z-side. When the sheet support device 20 is in the retracted state, each of the second abutment section 22*a*, the third abutment section 23*a*, and the first abutment section 21*c* extends in the −Y direction.

In the FIG. 11A, the sheet support device 20 is in the retracted state, in which case the third abutment section 23*a* of the third support section 23, the second abutment section 22*a* of the second support section 22, and the first abutment section 21*c* of the first support section 21 are positioned below the locking section 24*c* in this order from the top to the bottom. In this state, when the user pulls up the gripper 23*b* of the third support section 23, the third abutment section 23*a* of the third support section 23 abuts against the locking section 24*c*, thereby lifting up the base 24. With this lift-up of the base 24, the first support section 21 is displaced upward because the base 24 is rotatably coupled to the first support section 21. In the end, the first abutment section 21*c* of the first support section 21 lifts up the second support section 22. In this way, all of the first support section 21, the second support section 22, the third support section 23, and the base 24 are integrally moved upward, as illustrated in FIG. 4.

In FIG. 11B, the first support section 21 in the second position has been pivoted and thereby switched from the transition attitude to the support attitude. When the first support section 21 is switched from the transition attitude to the support attitude, both the second support section 22 and the third support section 23 move away from the locking section 24*c*, thereby releasing the lock that has been set by the locking mechanism 30. In other words, the third abutment section 23*a* of the third support section 23 moves away from the locking section 24*c*, thereby releasing the lock that has been set the locking mechanism 30. After the release of the lock that has been set by the locking mechanism 30, both the second support section 22 and the third support section 23 can protrude extended from the first support section 21, that is, the sheet support device 20 can be extended.

As described above, the locking mechanism 30 reliably maintains the positional relationships between the first support section 21 and the second support section 22 and between the first support section 21 and the third support section 23 at least until the first support section 21 has transited from the first position to the second position. When the sheet support device 20 is switched from the retracted state to the extended state, the first support section 21 and the second support section 22 are extended in this order. This means that the first support section 21 and the second support section 22 are extended in an orderly sequence.

Figure 21A:
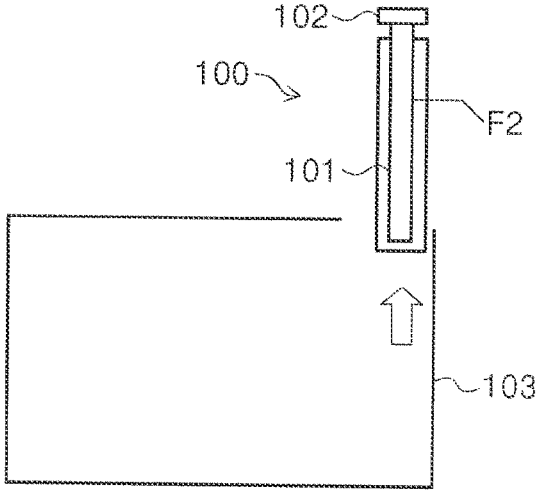
FIG. 21A PRIOR ART
FIG. 21A is a schematic view of a medium support device in the prior art.
Figure 21B:
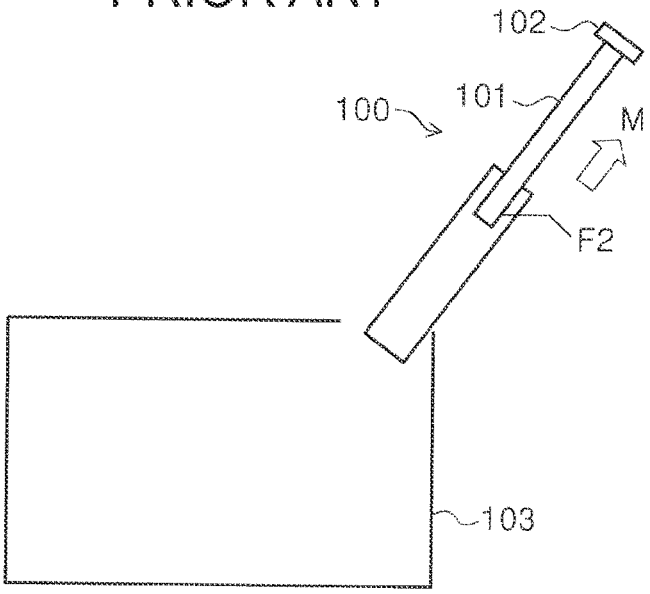
FIG. 21B PRIOR ART
FIG. 21B is a schematic view of the medium support device in the prior art.

The configuration in this embodiment is effective in decreasing or minimizing the retentive force by which the second support section 22 is kept inside the first support section 21, compared with the configuration of FIGS. 21A and 21B, in which it is necessary to appropriately set the retentive force F2 by which the second member 102 is kept inside the first member 101 in order to extend the first member 101 and the second member 102 in an orderly sequence when the user pulls up both the first member 101 and the second member 102. Therefore, the configuration in this embodiment enables the user to operate the sheet support device 20 at a reduced or minimized operating force, thereby providing good operability for the user. In this embodiment, a first retainer 31 (see FIGS. 14 and 18) corresponds to a mechanism for keeping the second support section 22 inside the first support section 21. Details of the first retainer 31 will be described later.

Although the sheet support device 20 includes the third support section 23 in this embodiment, it does not necessarily have to include the third support section 23. The sheet support device 20 may include another component instead of or in addition to the third support section 23 as long as it is possible to produce the above effect of the locking mechanism 30. Even if the sheet support device 20 does not include the third support section 23, the second abutment section 22*a* of the second support section 22 may produce substantially the same effect as the third abutment section 23*a* of the third support section 23. More specifically, the second abutment section 22*a* of the second support section 22 can abut against the locking section 24*c*, thereby enabling the locking mechanism 30 to set the lock to both the first support section 21 and the second support section 22.

In this embodiment, the locking mechanism 30 enables the user to easily release the lock to both the first support section 21 and the second support section 22. More specifically, the user can release the lock to both the first support section 21 and the second support section 22 by switching the first support section 21 from the first position to the second position and then by transiting the first support section 21 from the transition attitude to the support attitude. With the locking mechanism 30 formed of the locking section 24*c* having a protruding shape, the locking mechanism 30 can be formed with a simple structure and at a low cost.

The configuration of the locking mechanism 30 is not limited: alternatively, it may release the lock to both the first support section 21 and the second support section 22 simply in response to the transition of the first support section 21 from the first position to the second position. In this case, the first support section 21 does not necessarily have to be configured to switch its attitude. Alternatively, the locking section 24*c* may be implemented by an actuator such as a solenoid, in which case the locking section 24*c* may be movable relative to the second support section 22. When the first support section 21 transits from the first position to the second position, the locking section 24*c* may move away from the second support section 22.

In this embodiment, the first support section 21 is restricted to rotating from the transition attitude to the support attitude while transiting between the first position and the second position. This configuration reduces the risk of the locking mechanism 30 accidentally releasing the lock that has been set by the locking mechanism 30.

Figure 12:
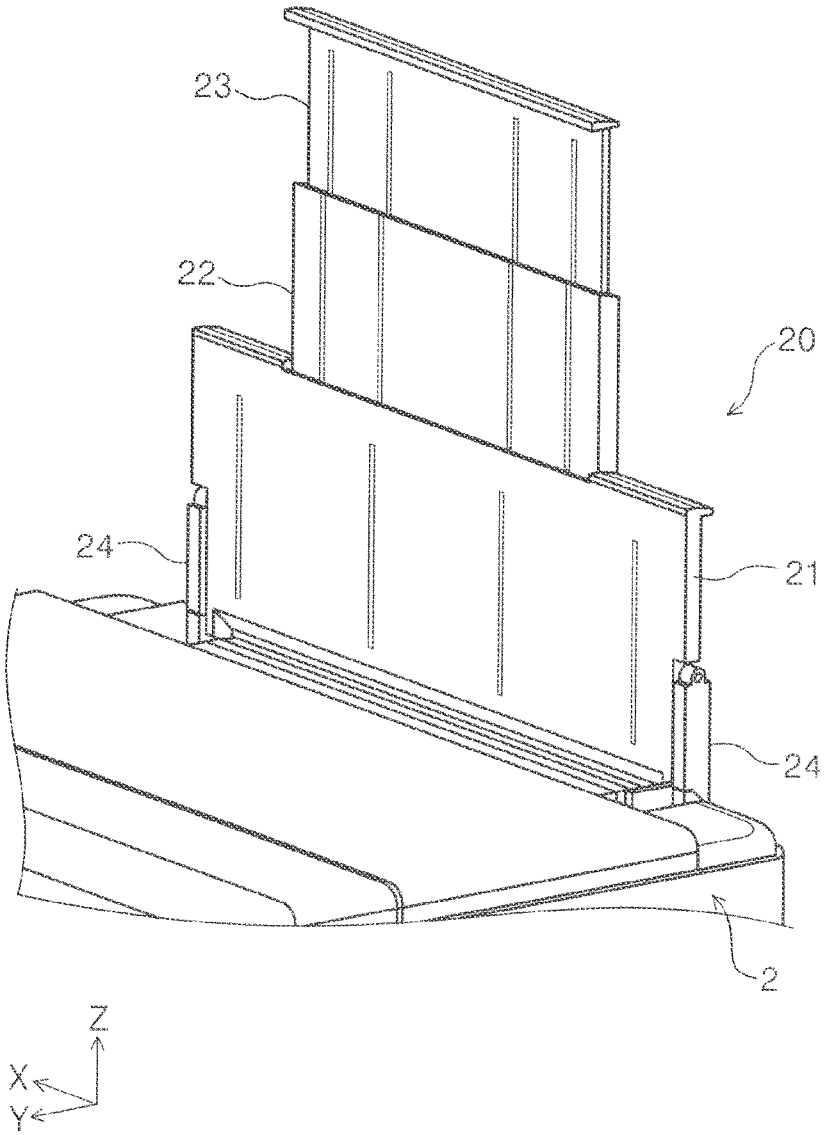
FIG. 12 is a front perspective view of the sheet support device in the transition attitude where the second support section protrudes from the first support section and the third support section protrudes from the second support section.

The sheet support device 20 can be switched from the extended state to the retracted state through user's operations in the following sequence. First, the user retracts the second support section 22 that has protruded from the first support section 21 (see FIG. 6) into the first support section 21 (see FIG. 5). Then, the user transits the first support section 21 from the support attitude (see FIG. 5) to the transition attitude (see FIG. 4) by pivoting the first support section 21 forward, after which he/she transits the first support section 21 from the second position to the first position. Unfortunately, in some cases, a user may first transit the first support section 21 from the support attitude to the transition attitude by pivoting the first support section 21 forward, with the second support section 22 protruding from the first support section 21, as illustrated in FIG. 12. Then, he/she may transit the first support section 21 from the second position to the first position. Those irregular operations would cause the second abutment section 22*a* of the second support section 22 to which the locking section 24*c* has set the lock to collide against the locking section 24*c*, as can be seen from FIG. 13A. This might hinder the second support section 22 from being retracted into the first support section 21.

Figure 13A:
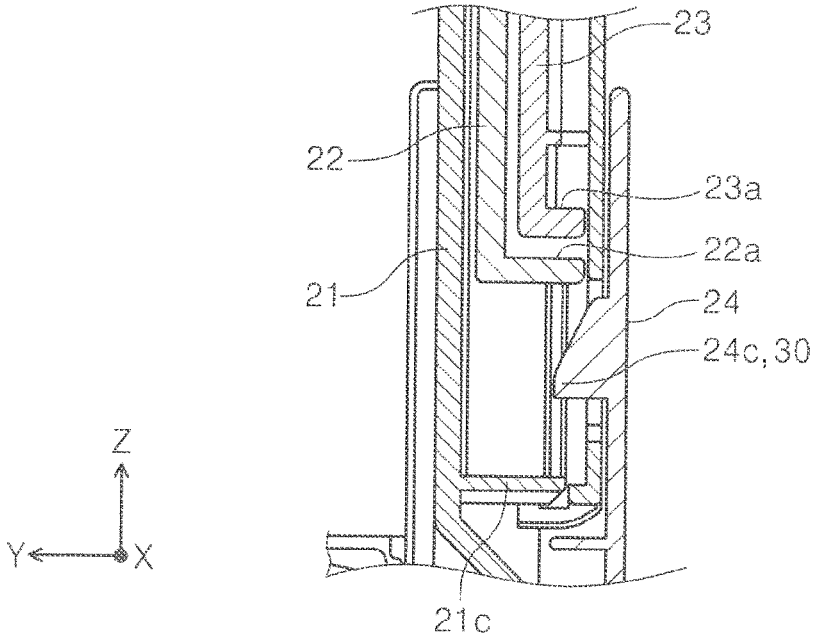
FIG. 13A is a partial cross-sectional view of the locking section and the surrounding components during irregular operations of the sheet support device.
Figure 13B:
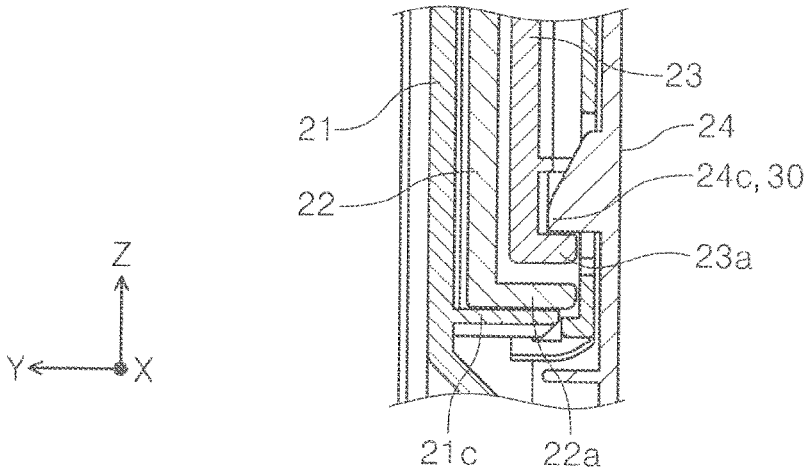
FIG. 13B is a partial cross-sectional view of the locking section and the surrounding components after the irregular operations of the sheet support device.

In this embodiment, however, the base 24, which may be made of a resin material, is flexibly warped in the −Y direction, thereby causing the second abutment section 22*a* of the second support section 22 and the third abutment section 23*a* of the third support section 23 to move beyond the locking section 24*c*, as illustrated in FIGS. 13A and 13B. Furthermore, the shape of the locking section 24*c*, which is inclined on the +Z-side in this embodiment, helps the second abutment section 22*a* of the second support section 22 and the third abutment section 23*a* of the third support section 23 to move beyond the locking section 24*c*. Regardless of whether the above irregular operations are operated or not, the sheet support device 20 reliably enables the user to switch from the extended state to the retracted state with minimal risk of damaging the locking section 24*c*.

As described above, the locking section 24*c* is formed on the base 24 at the center in the +X direction (not illustrated). Therefore, the base 24 is warped easily in response to the irregular operations, thereby further helping the second abutment section 22*a* of the second support section 22 and the third abutment section 23*a* of the third support section 23 to move beyond the locking section 24*c*.

Next, a description will be given below of the first retainer 31, a second retainer 32, a third retainer 33, and a fourth retainer 34, all of which are components in the sheet support device 20. The first retainer 31 keeps the state where the second support section 22 is retracted into the first support section 21 when the first support section 21 is in the second position; the second retainer 32 keeps a state where the second support section 22 protrudes from the first support section 21; the third retainer 33 keeps a state where the third support section 23 is retracted into the second support section 22 when the first support section 21 is in the second position; and the fourth retainer 34 keeps a state where the third support section 23 protrudes from the second support section 22. Herein, the second retainer 32 corresponds to a second support retainer, and the fourth retainer 34 corresponds to a third support retainer. Those retainer components ensure the sequences in which the second support section 22 is extended from and retracted into the third support section 23.

Figure 18:
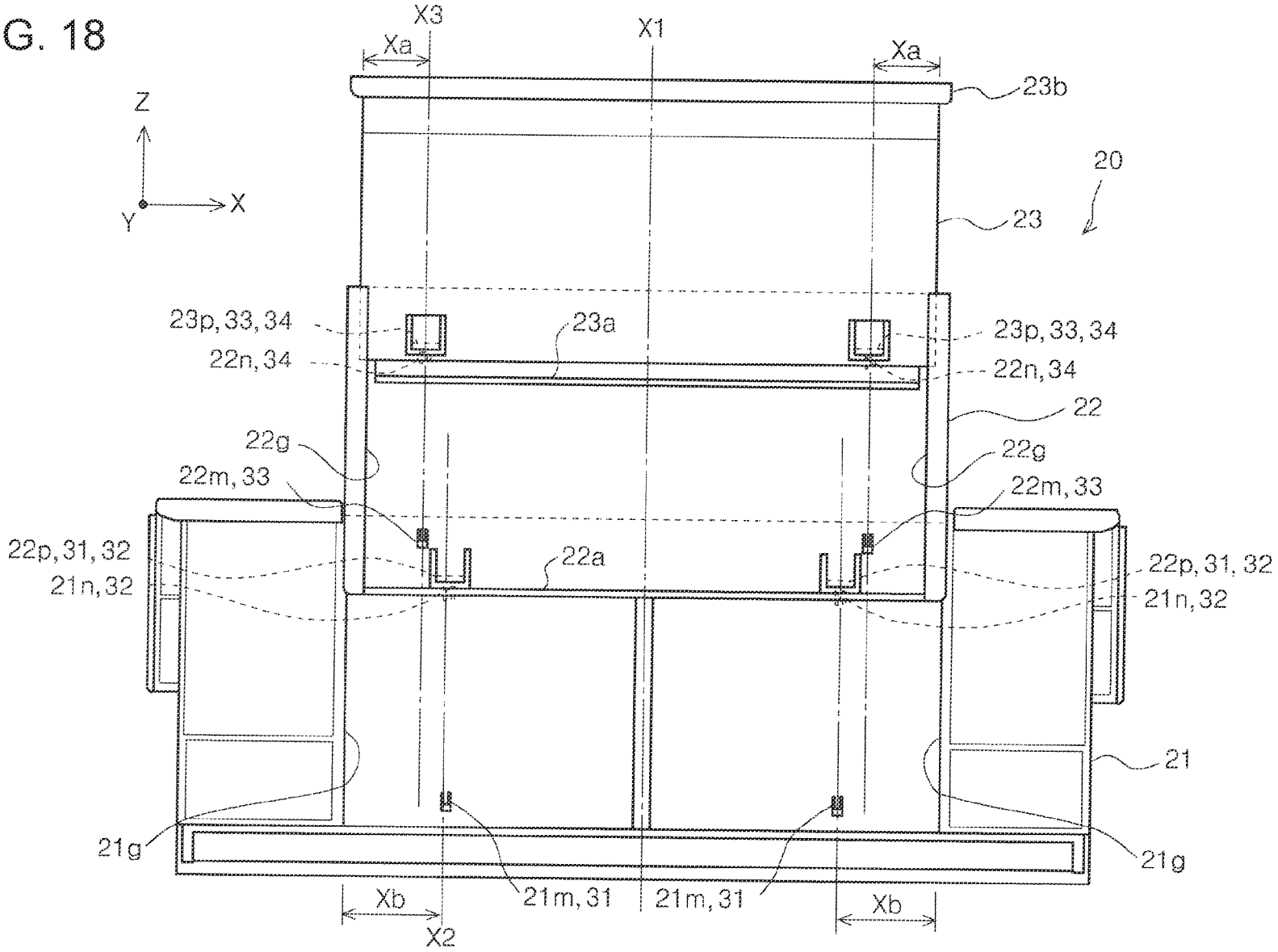
FIG. 18 is a rear plan view of the sheet support device.
Figure 20:
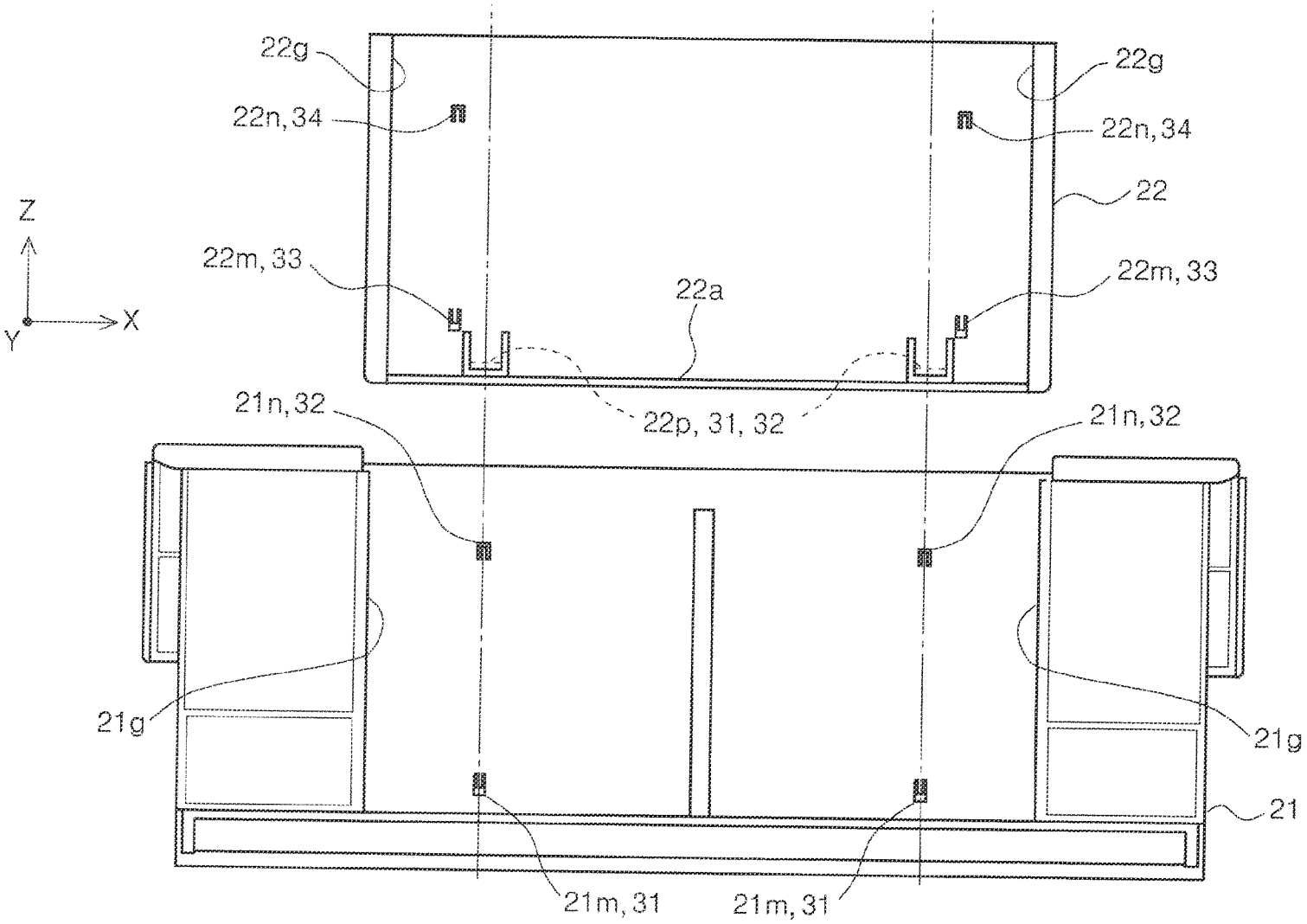
FIG. 20 is a rear plan view of the first support section and the second support section that are separated from each other.

A description will be given below of the first retainer 31, which keeps the state where the second support section 22 is retracted into the first support section 21 when the first support section 21 is in the second position. As illustrated in FIGS. 18 and 20, the first retainer 31 includes: two projections 21*m* formed in the first support section 21; and two projections 22*p* formed in the second support section 22. As illustrated in FIG. 14, each of the projections 21*m* protrudes toward the second support section 22, whereas each of the projections 22*p* protrudes toward the first support section 21. The projections 22*p* are formed at one side of an elastic piece formed integrally with the second support section 22 and are kept in contact with the projection 21*m* by an elastic force.

To make the second support section 22 protrude from the first support section 21, the user needs to move the projections 22*p* beyond the projections 21*m* by pulling up the second support section 22 at a resistance force, referred to below as a first resistance force, which can be equivalent to the retentive force by which the second support section 22 is kept inside the first support section 21 in the second position (see FIG. 5). This first retentive force can be adjusted by varying the height of each projection 21*m* and the elastic force by which the projections 22*p* are kept in contact with the projections 21*m*.

Figure 19:
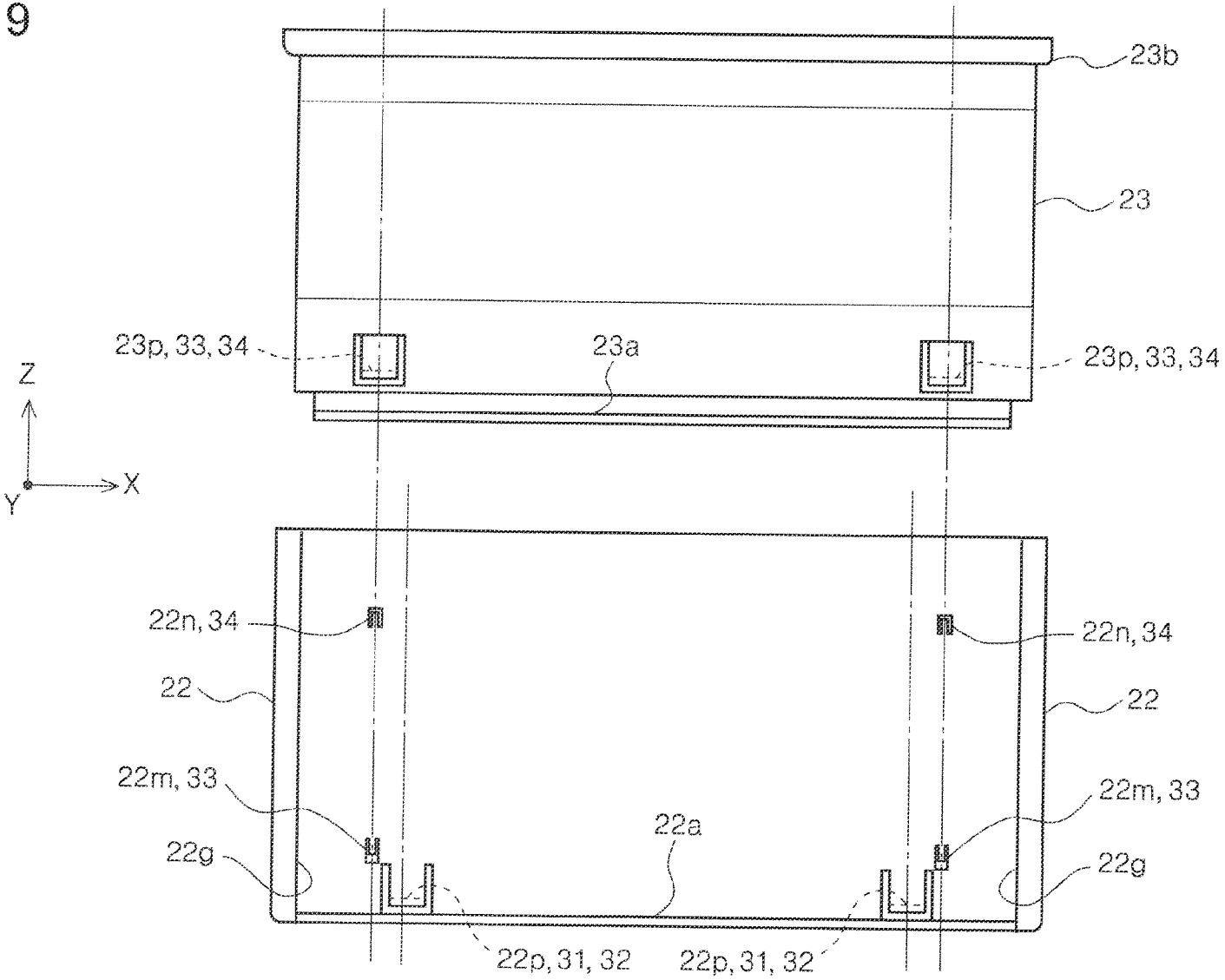
FIG. 19 is a rear plan view of the second support section and the third support section that are separated from each other.

A description will be given below of the third retainer 33, which keeps a state where the third support section 23 is retracted into the second support section 22 when the first support section 21 is in the second position. As illustrated in FIGS. 18 and 19, the third retainer 33 includes: two projections 22*m* formed in the second support section 22; and two projections 23*p* formed in the third support section 23. As illustrated in FIG. 15, each of the projections 22*m* protrudes toward the third support section 23, whereas each of the projections 23*p* protrudes toward the second support section 22. The projections 23*p* are formed on one side of an elastic piece formed integrally with the third support section 23 and are kept in contact with the projection 22*m* by an elastic force.

To make the third support section 23 protrude from the second support section 22, the user needs to move the projections 23*p* beyond the projections 22*m* by pulling up the third support section 23 at a resistance force, referred to below as a second resistance force, which can be equivalent to the retentive force by which the third support section 23 is kept inside the second support section 22 in the second position (see FIGS. 5 and 6). This second retentive force can be adjusted by varying the height of each projection 22*m* and the elastic force by which the projections 23*p* are kept in contact with the projections 22*m*.

In this embodiment, the first retentive force is set to be weaker than the second retentive force. The relationship between the first and second retentive forces are adjusted by the heights of the projections 21*m* and 22*m*. In this case, the projections 21*m* are set to be lower than the projections 22*m*. When the user pulls up the third support section 23 from the second support section 22 retracted into the first support section 21 (see FIG. 5), the second support section 22 first protrudes from the first support section 21 (see FIG. 6), and then the third support section 23 protrudes from the second support section 22 (see FIG. 7). In this way, the second support section 22 and the third support section 23 are extended in an orderly sequence.

Next, a description will be given below of the second retainer 32, or the second support retainer, which keeps a state where the second support section 22 protrudes from the first support section 21. As illustrated in FIGS. 18 and 20, the second retainer 32 includes: two projections 21*n* formed in the first support section 21; and two projections 22*p* in the second support section 22. As illustrated in FIG. 16, each of the projections 21*n* protrudes toward the second support section 22, whereas each of the projections 22*p* protrudes toward the first support section 21. Herein, the projections 21*n* correspond to an example of a first coupler, and the projections 22*p* correspond to an example of a second coupler.

To retract the second support section 22 that has been in the protruding state (see FIGS. 16 and 18) into the first support section 21, the user needs to move the projections 22*p* beyond the projections 21*n* by pushing down the second support section 22 at a resistance force, referred to below as a third resistance force, which can be equivalent to the retentive force by which the second support section 22 is kept protruding from the first support section 21. This third retentive force can be adjusted by varying the height of each projection 21*n* and the elastic force by which the projections 22*p* are kept in contact with the projection 21*n*.

Next, a description will be given below of the fourth retainer 34, or the third support retainer, which keeps a state where the third support section 23 protrudes from the second support section 22. As illustrated in FIGS. 18 and 19, the fourth retainer 34 includes: two projections 22*n* formed in the second support section 22; and two projections 23*p* in the third support section 23. As illustrated in FIG. 17, each of the projections 22*n* protrudes toward the third support section 23, whereas each of the projections 23*p* protrudes toward the second support section 22. Herein, the projections 22*n* correspond to an example of a third coupler, and the projections 23*p* correspond to an example of a fourth coupler.

To retract the third support section 23 that has been in the protruding state (see FIGS. 17 and 18) into the second support section 22, the user needs to move the projections 23*p* beyond the projections 22*n* by pushing down the third support section 23 at a resistance force, referred to below as a fourth resistance force, which can be equivalent to the retentive force by which the third support section 23 is kept protruding from the second support section 22. This fourth retentive force can be adjusted by varying the height of each projection 22*n* and the elastic force by which the projections 23*p* are kept in contact with the projection 22*n*.

In this embodiment, the fourth retentive force is set to be weaker than the third retentive force. For this purpose, the projections 22*n* are set to be lower than the projections 21*n*. When the user pulls down the third support section 23 protruding from the second support section 22, which protrudes from the first support section 21 (see FIG. 7), the third support section 23 is first extracted into the second support section 22 (see FIG. 6), and then the second support section 22 is extracted into the first support section 21 (see FIG. 5). In this way, the second support section 22 and the third support section 23 are retracted into an orderly sequence.

As described above, each of the second support section 22 and the third support section 23 can be kept in the protruding state by the engagement of individual projections. In this case, if the second support section 22 or the third support section 23 is warped in the −Y direction or +Y direction, the projections move away from one another, thereby hindering the second support section 22 or the third support section 23 from keeping its protruding state appropriately. Therefore, it is preferable that the second retainer 32 that keeps the second support section 22 in the protruding state be formed near both edges of the first support section 21 and the second support section 22 on the ±X-sides and also that the fourth retainer 34 that keeps the third support section 23 in the protruding state be formed near the edges of the second support section 22 and the third support section 23 on the ±X-sides.

As illustrated in FIGS. 18 and 20, the second support section 22 transits between the protruding position and the retracted position with its ±X edges guided along respective guide sections 21*g* in the first support section 21. In this structure, the second retainer 32 is preferably formed near the guide sections 21*g* in the +X direction because the second retainer 32 formed nearer the guide sections 21*g* can make the second support section 22 less likely to move away from the first support section 21 when the second support section 22 is warped. Likewise, as illustrated in FIGS. 18 and 19, the third support section 23 transits between the protruding position and the retracted position with its ±X edges guided along respective guide sections 22*g* in the second support section 22. In this structure, the fourth retainer 34 is preferably formed near the guide sections 22*g* in the +X direction because the fourth retainer 34 formed nearer the guide sections 22*g* can make less likely to move the third support section 23 away from the second support section 22 when the third support section 23 is warped.

In this embodiment, as illustrated in FIG. 18, a distance Xa is set to be shorter than a distance Xb: the distance Xa is defined as the distance in a width or +X direction between the fourth retainer 34 and each of the guide sections 22*g* along which the third support section 23 is guided by the second support section 22; and the distance Xb is defined as the distance in the width or the +X direction between the second retainer 32 and each of the guide sections 21*g* along which the second support section 22 is guided by the first support section 21. When the sheet support device 20 is in the extended state, the third support section 23 that protrudes from the second support section 22 is more likely to be warped than the second support section 22 is. In other words, the stiffness of the third support section 23 is more difficult to ensure than that of the second support section 22 is. Setting the distances Xa and Xb in this manner can appropriately maintain the retentive force by which the third support section 23, the stiffness of which is more difficult to ensure than that of the second support section 22 is, is kept protruding from the second support section 22.

In the foregoing embodiment, the sheet support device 20 is implemented by a device that supports paper sheets to be fed to the printer 1, which is an example of a recording apparatus. However, the sheet support device 20 may be implemented by a device that receives paper sheets processed and ejected by the printer 1. In the embodiment, the processor is implemented by the recording head 15 that processes media; however, it may be implemented by a reader that reads images. The medium support device may be applied to an image reading apparatus such as a scanner. In which case, the medium support device may also be implemented by either a device that supports media to be fed to the image reading apparatus or a device that receives paper sheets read by the image reading apparatus.

It is obvious that the present disclosure is not limited to the foregoing embodiment, and thus this embodiment can undergo various modifications and variations within the scope of the claims, in which case the modified or varied embodiment still falls within the scope of the present disclosure.

What is claimed is:

1. A medium support device configured to switch between an extended state where a support surface of the medium support device which supports a medium is extended from a main body and a retracted state where the support surface of the medium support device is retracted into the main body, the main body having a processor that processes the medium, the medium support device comprising:

a first support section configured to transit between a first position and a second position relative to the main body;

a second support section configured to transit between a position in which the second support section is retracted into the first support section and a position in which the second support section protrudes from the first support section, the second support section being supported by the first support section; and a locking mechanism configured to set a lock to the second support section, wherein when the first support section is in the first position and the second support section is retracted into the first support section, the retracted state is formed, when the first support section is in the second position and the second support section protrudes from the first support section, the extended state is formed, the locking mechanism sets the lock to the second support section retracted into the first support section when the first support section is in the first position and, in turn, releases the lock when the first support section is in the second position.

2. The medium support device according to claim 1, further comprising a base that pivotably supports the first support section, the base being displaced relative to the main body to cause the first support section to transit between the first position and the second position, wherein the first support section is configured to pivot relative to the base to switch between a transition attitude in which the first support section transits between the first position and the second position and a support attitude in which the first support section supports the medium, and when the first support section is in the second position and switches from the transition attitude to the support attitude, the locking mechanism releases the lock.

3. The medium support device according to claim 2, wherein when the first support section is the support attitude, the base supports the first support section together with a frame of the main body.

4. The medium support device according to claim 3, wherein the locking mechanism includes a locking section disposed in the base, the locking section sets the lock to the second support section retracted into the first support section, and when the first support section in the second position, the first support section switches from the transition attitude to the support attitude, with a result that the second support section moves away from the locking section to cause the locking section to release the lock.

5. The medium support device according to claim 4, wherein while transiting between the first position and the second position, the first support section is restricted to rotating from the transition attitude to the support attitude.

6. The medium support device according to claim 4, wherein the first support section switches from the support attitude to the transition attitude while the second support section keeps protruding from the first support section, and then when the first support section transits from the second position to the first position, the base is configured to warp for the locking section to set the lock to the second support section.

7. The medium support device according to claim 2, wherein the locking mechanism includes a locking section disposed in the base, the locking section sets the lock to the second support section retracted into the first support section, and when the first support section in the second position, the first support section switches from the transition attitude to the support attitude, with a result that the second support section moves away from the locking section to cause the locking section to release the lock.

8. The medium support device according to claim 7, wherein while transiting between the first position and the second position, the first support section is restricted to rotating from the transition attitude to the support attitude.

9. The medium support device according to claim 7, wherein the first support section switches from the support attitude to the transition attitude while the second support section keeps protruding from the first support section, and then when the first support section transits from the second position to the first position, the base is configured to be warped for the locking section to set the lock to the second support section.

10. The medium support device according to claim 9, further comprising, a third support section configured to transit between a position in which the third support section is retracted into the second support section and a position in which the third support section protrudes from the second support section, the third support section being supported by the second support section, wherein the locking mechanism is configured to set a lock to the third support section, and the locking mechanism sets the lock to the third support section retracted into the second support section when the first support section transits to the first position and, in turn, releases the lock when the first support section transits to the second position.

11. The medium support device according to claim 10, further comprising:

a second support retainer that keeps a state where the second support section protrudes from the first support section; and a third support retainer that keeps a state where the third support section protrudes from the second support section, wherein the second support retainer includes a first coupler and a second coupler, the first coupler being disposed in one of the first support section and the second support section, the second coupler being disposed in the other of the first support section and the second support section, the second coupler being kept in contact with the first coupler by an elastic force, the third support retainer includes a third coupler and a fourth coupler, the third coupler being disposed in one of the second support section and the third support section, the fourth coupler being disposed in the other of the second support section and the third support section, the fourth coupler being kept in contact with the third coupler by an elastic force, the second support section is guided at both edges in a width direction by the first support section, the width direction intersecting a direction in which the medium is to be fed, the third support section is guided at both edges in the width direction by the second support section, and a distance in the width direction between the third support retainer and a location at which the third support section is guided by the second support section is set to be shorter than a distance between the second support retainer and a location at which the second support section is guided by the first support section.

12. The medium support device according to claim 7, further comprising, a third support section configured to transit between a position in which the third support section is retracted into the second support section and a position in which the third support section protrudes from the second support section, the third support section being supported by the second support section, wherein the locking mechanism is configured to set a lock to the third support section, and the locking mechanism sets the lock to the third support section retracted into the second support section when the first support section transits to the first position and, in turn, releases the lock when the first support section transits to the second position.

13. The medium support device according to claim 12, further comprising:

a second support retainer that keeps a state where the second support section protrudes from the first support section; and a third support retainer that keeps a state where the third support section protrudes from the second support section, wherein the second support retainer includes a first coupler and a second coupler, the first coupler being disposed in one of the first support section and the second support section, the second coupler being disposed in the other of the first support section and the second support section, the second coupler being kept in contact with the first coupler by an elastic force, the third support retainer includes a third coupler and a fourth coupler, the third coupler being disposed in one of the second support section and the third support section, the fourth coupler being disposed in the other of the second support section and the third support section, the fourth coupler being kept in contact with the third coupler by an elastic force, the second support section is guided at both edges in a width direction by the first support section, the width direction intersecting a direction in which the medium is to be fed, the third support section is guided at both edges in the width direction by the second support section, and a distance in the width direction between the third support retainer and a location at which the third support section is guided by the second support section is set to be shorter than a distance between the second support retainer and a location at which the second support section is guided by the first support section.

14. A recording apparatus comprising:

a recording head that performs a record operation on a medium, the recording head acting as the processor; and the medium support device according to claim 1 that supports a medium to be fed to the recording head.

15. The recording apparatus according to claim 14, wherein the medium support device is disposed on a rear surface of the recording apparatus to form a portion of the rear surface of the recording apparatus.

* * * * *